US008273977B2

(12) United States Patent
Uehara

(10) Patent No.: US 8,273,977 B2
(45) Date of Patent: Sep. 25, 2012

(54) AUDIO SYSTEM, SIGNAL PRODUCING APPARATUS AND SOUND PRODUCING APPARATUS

(75) Inventor: Haruki Uehara, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 613 days.

(21) Appl. No.: 12/038,979

(22) Filed: Feb. 28, 2008

(65) Prior Publication Data

US 2008/0236372 A1 Oct. 2, 2008

(30) Foreign Application Priority Data

Mar. 28, 2007 (JP) ..... 2007-084216

(51) Int. Cl.
*A63H 5/00* (2006.01)
*G04B 13/00* (2006.01)
*G10H 7/00* (2006.01)

(52) U.S. Cl. ..... 84/609; 84/645

(58) Field of Classification Search ..... 84/645, 84/609

See application file for complete search history.

(56) References Cited

U.S. PATENT DOCUMENTS

| | | | | |
|---|---|---|---|---|
| 6,122,682 | A * | 9/2000 | Andrews | 710/65 |
| 6,184,454 | B1 * | 2/2001 | Imai et al. | 84/622 |
| 6,281,424 | B1 * | 8/2001 | Koike et al. | 84/636 |
| 6,380,473 | B2 * | 4/2002 | Uehara | 84/609 |
| 6,600,097 | B2 * | 7/2003 | Shiiya | 84/609 |
| 6,800,799 | B2 * | 10/2004 | Fujiwara et al. | 84/645 |
| 6,956,162 | B2 * | 10/2005 | Koseki et al. | 84/609 |
| 7,649,136 | B2 * | 1/2010 | Uehara | 84/610 |
| 2006/0272483 | A1 * | 12/2006 | Honeywell | 84/609 |
| 2007/0226293 | A1 | 9/2007 | Sakurada et al. | |

FOREIGN PATENT DOCUMENTS

| | | |
|---|---|---|
| EP | 1746577 | 1/2007 |
| EP | 1746774 | 1/2007 |
| JP | 2003-271138 | 9/2003 |
| JP | 2006-323161 | 11/2006 |

* cited by examiner

*Primary Examiner* — Jeffrey Donels
(74) *Attorney, Agent, or Firm* — Harness, Dickey & Pierce, PLC

(57) ABSTRACT

An audio player is connected to an automatic playing musical instrument, and command files and audio data files are prepared in the file format defined in the Red Book in the audio player, although the time data are stored in the time data fields of the longitudinal time codes, the user's data fields are available for commands to the automatic player and identification of a music data file; when a user instructs the audio player to control the automatic player for a solo performance, a quasi audio signal is produced from the command data for the solo performance; when a user instructs to a performance in collaboration with the automatic player, the audio signal, which expresses the pieces of audio data and a music data file, is supplied to the automatic player so as to reproduce the music tune through the acoustic tones and electric tones.

20 Claims, 12 Drawing Sheets

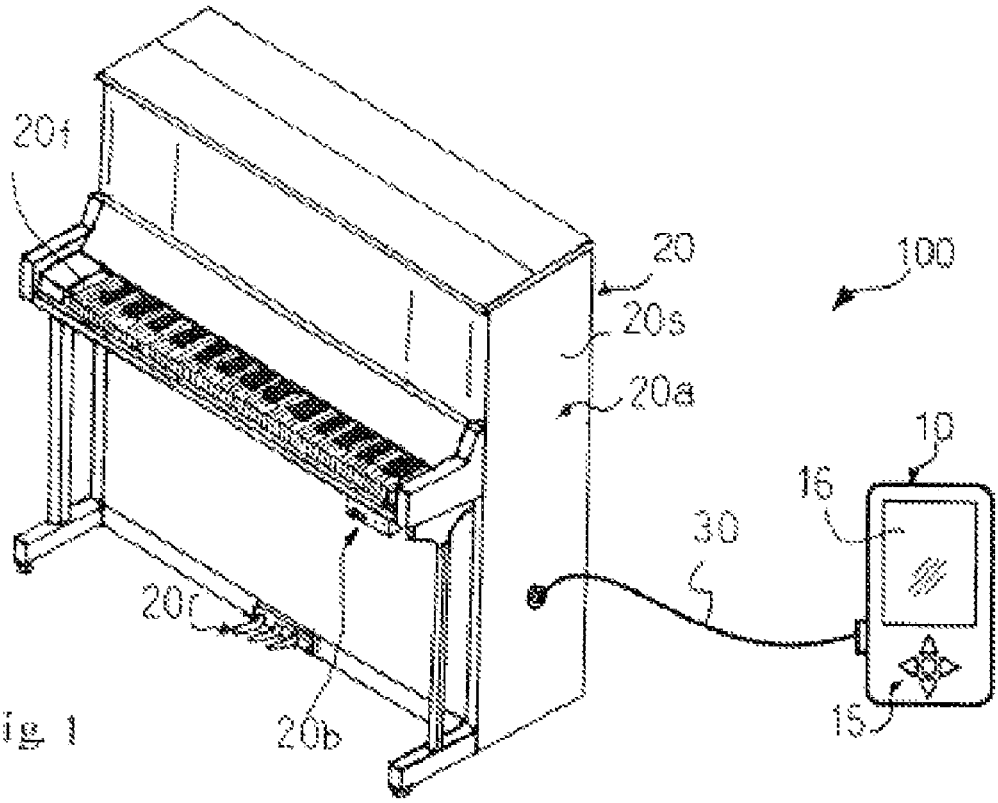
Fig. 1
Fig. 2
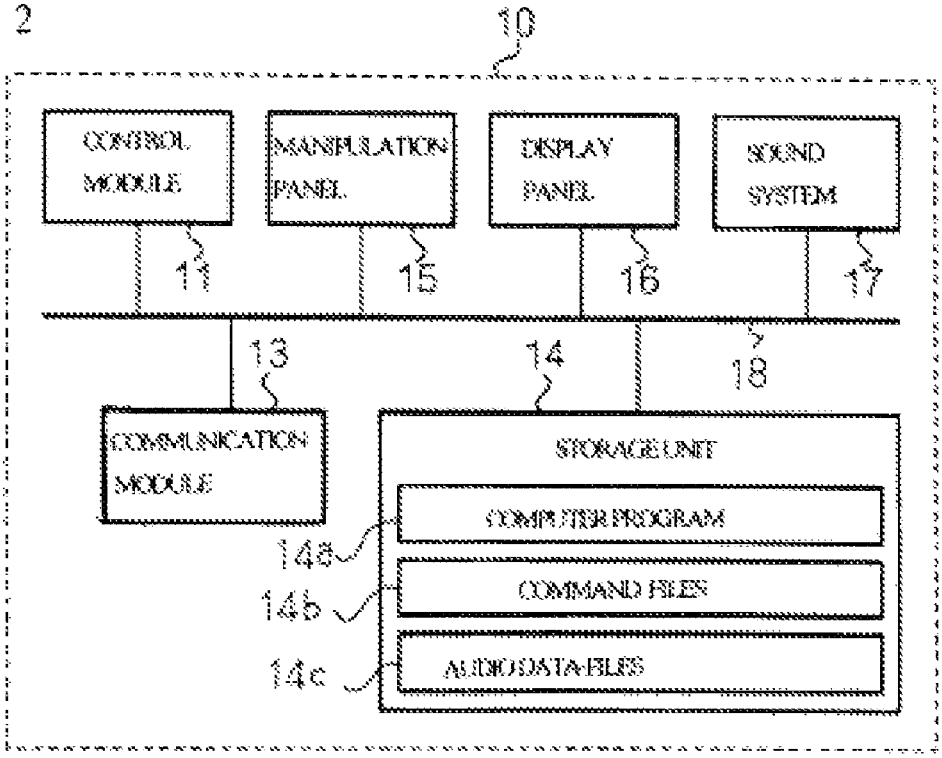

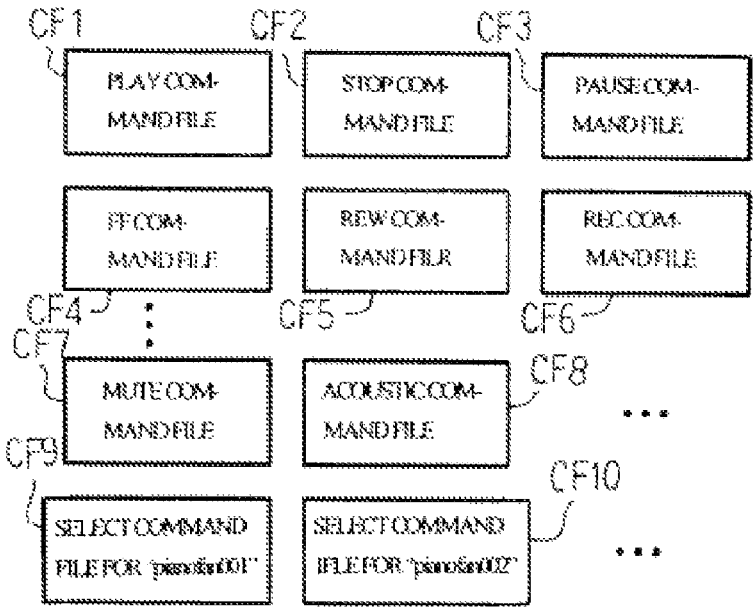
Fig 6
Fig. 7B
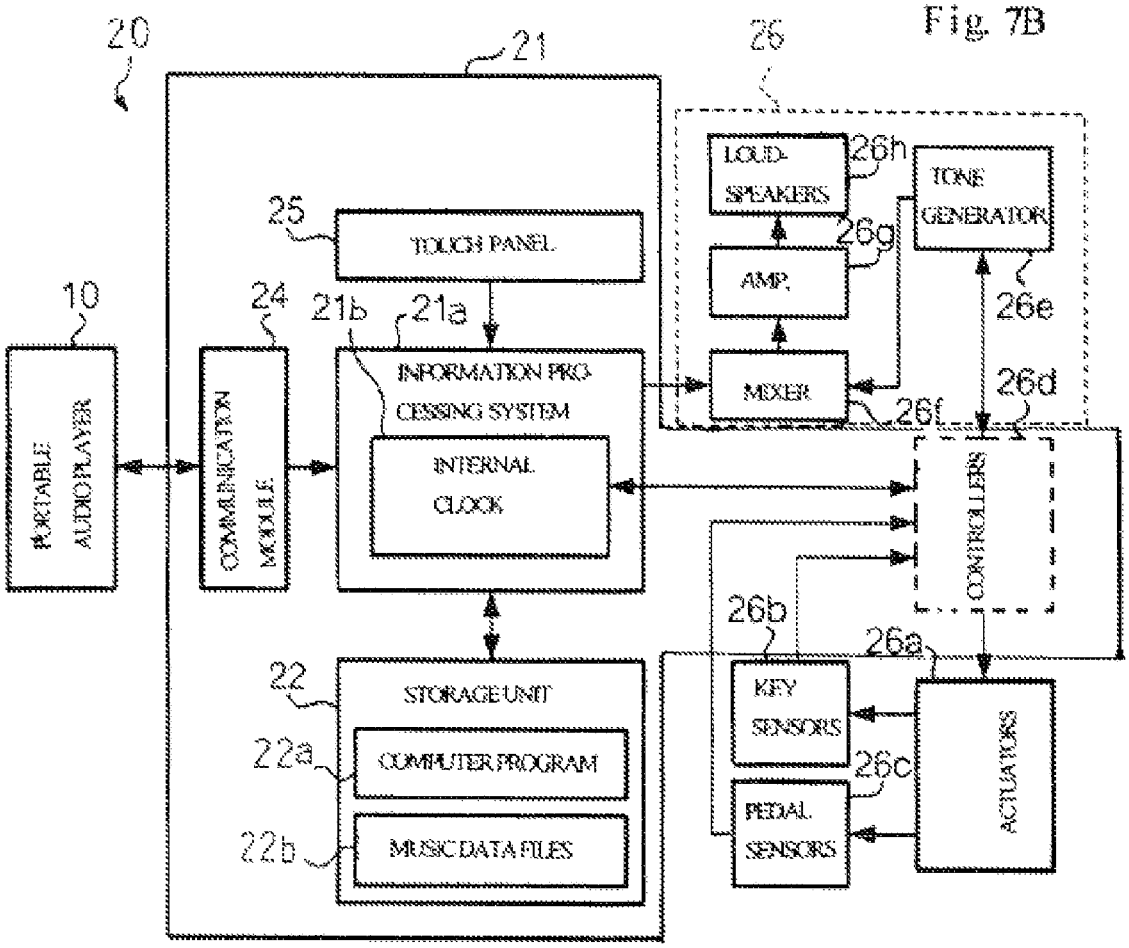

AUDIO SYSTEM, SIGNAL PRODUCING APPARATUS AND SOUND PRODUCING APPARATUS

FIELD OF THE INVENTION

This invention relates to an audio system for reproducing tones of music tunes and, more particularly, to an audio system constituted by a communication channel, a signal producing apparatus and a sound reproducing apparatus collaborated with the signal producing apparatus for performances of music tunes.

DESCRIPTION OF THE RELATED ART

Various sorts of audio playback apparatus have been proposed to music fans. A sort of audio playback apparatus restores audio data codes, which express discrete values on the waveform of the analog audio signal, to the analog audio signal, and electric tones are reproduced from the analog audio signal.

Another sort of audio playback apparatus reproduces acoustic tones through an acoustic musical instrument on the basis of music data codes, and is called as "automatic player musical instrument". There are electronic musical instruments, which produce electronic tones on the basis of the music data codes. The formats of music data codes are, by way of example, defined in the MIDI (Musical Instrument Digital Interface) protocols. The generation of an acoustic tone or electronic tone is given as a voice message expressed by a status byte and data bytes, and the data bytes express the note number of acoustic tone/electronic tone and the velocity, i.e., the loudness of acoustic tone/electronic tone. Thus, the audio data codes are not compatible with the music data codes, and the audio playback apparatus designed to process the audio data codes can not produce the electric tones from the music data codes and vice versa.

A typical example of the automatic player musical instrument is disclosed in Japan Patent Application laid-open No. 2003-271138, and the prior art automatic player musical instrument reenacts the performance expressed by a set of music data codes in synchronism with the playback through the audio playback apparatus, which converts the audio data codes to the electric tones.

The prior art automatic player musical instrument is the combination of the acoustic piano and automatic playing system, and users give their instructions to the automatic playing system through a manipulating panel by depressing a corresponding a button switch with their fingers. If a user wishes to give the instructions to the automatic playing system remote from them, a remote controller and transmitter/receiver are required for remote control.

It is expensive to make the prior art automatic player musical instrument equipped with the remote control system. Even if the remote control system is installed in the automatic player musical instrument, the user needs to give instructions to the audio playback apparatus independently of the instructions to the automatic playing system. In other words, the user individually gives the instructions to the system components of the prior art audio system. Although the prior art automatic player musical instrument communicates with the prior art audio playback apparatus for the synchronization, the control signal for the prior art audio playback system is not understandable by the prior art automatic player musical instrument.

SUMMARY OF THE INVENTION

It is therefore an important object of the present invention to provide an audio system, the system components of which are communicable with one another for transferring user's instructions among them.

It is another important object of the present invention to provide a signal producing apparatus, which serves as one of the system components.

It is also an important object of the present invention to provide a reproducing apparatus, which is controllable with the signal producing apparatus.

The present invention proposes to prepare at least one audio data file and at least one command file in a common file format so as to control a sound reproducing apparatus with a quasi control signal produced from the command file in a similar manner to an audio signal expressing sound.

In accordance with one aspect of the present invention, there is provided an audio system for producing a music tune, and the audio system comprises a communication channel for propagating an audio signal and a quasi audio signal therethrough, a signal producing apparatus including a storage unit storing at least one audio data file having data blocks assigned to pieces of audio data expressing sound to be reproduced and other data blocks assigned to pieces of other sorts of data and at least one command file having data blocks corresponding to the data blocks of the aforesaid at least one audio file and other data blocks corresponding to the other data blocks of the aforesaid at least one audio file and assigned to at least one piece of command data expressing a command, a signal producing unit connected to the storage unit and producing the audio signal and the quasi audio signal from the pieces of audio data and the pieces of other sort of data in the aforesaid at least one audio data file and from the aforesaid at least one piece of command data in the aforesaid at least one command file and a communication unit connected to the signal producing unit and the communication channel and delivering the audio signal and the quasi audio signal to the communication channel and a sound producing apparatus including a communication unit connected to the communication channel and receiving the audio signal and the quasi audio signal, a signal-to-sound converter connected to the communication unit and responsive to the command so as to convert the audio signal to the sound and a command restorer connected to the communication unit and the signal-to-sound converter and restoring the quasi audio signal to the at least one piece of command data so as to control the signal-to-sound converter with the command.

In accordance with another aspect of the present invention, there is provided a signal producing apparatus communicable with a sound producing apparatus, and the signal producing apparatus comprises a storage unit storing at least one audio data file having data blocks assigned to pieces of audio data expressing sound to be reproduced and other data blocks assigned to pieces of other sorts of data and at least one command file having data blocks corresponding to the data blocks of the aforesaid at least one audio file and other data blocks corresponding to the other data blocks of the aforesaid at least one audio file and assigned to at least one piece of command data expressing a command, a signal producing unit connected to the storage unit and producing the audio signal and the quasi audio signal from the pieces of audio data and the pieces of other sort of data in the aforesaid at least one audio data file and from the aforesaid at least one piece of command data in the aforesaid at least one command file and a communication unit connected to the signal producing unit and a communication channel connectable to the sound producing apparatus and delivering the audio signal and the quasi audio signal to the communication channel.

In accordance with yet another aspect of the present invention, there is provided a sound reproducing apparatus controllable through a signal producing apparatus connected thereto through a communication channel, and the sound reproducing apparatus comprises a communication unit connected to the communication channel and receiving an audio signal representative of pieces of audio data and pieces of other sorts of data stored in an audio data file prepared in a file format and a quasi audio signal representative of at least one piece of command data stored in a command file prepared in the file format, a signal-to-sound converter connected to the communication unit and responsive to the command so as to produce sound and a command restorer connected to the communication unit and the signal-to-sound converter and restoring the quasi audio signal to the aforesaid at least one piece of command data expressing a command so as to control the signal-to-sound converter with the command.

BRIEF DESCRIPTION OF THE DRAWINGS

The features and advantages of the audio system, signal producing apparatus and sound reproducing apparatus will be more clearly understood from the following description taken in conjunction with the accompanying drawings, in which FIG. 1 is a perspective view showing the system configuration of an audio system of the present invention, FIG. 2 is a block diagram showing the system configuration of a portable audio player, FIG. 6 is a view showing various command files in the portable audio player, FIG. 7B is a block diagram showing the system configuration of an automatic playing system forming a part of the automatic player musical instrument.

DESCRIPTION OF THE PREFERRED EMBODIMENTS

Figure 3:
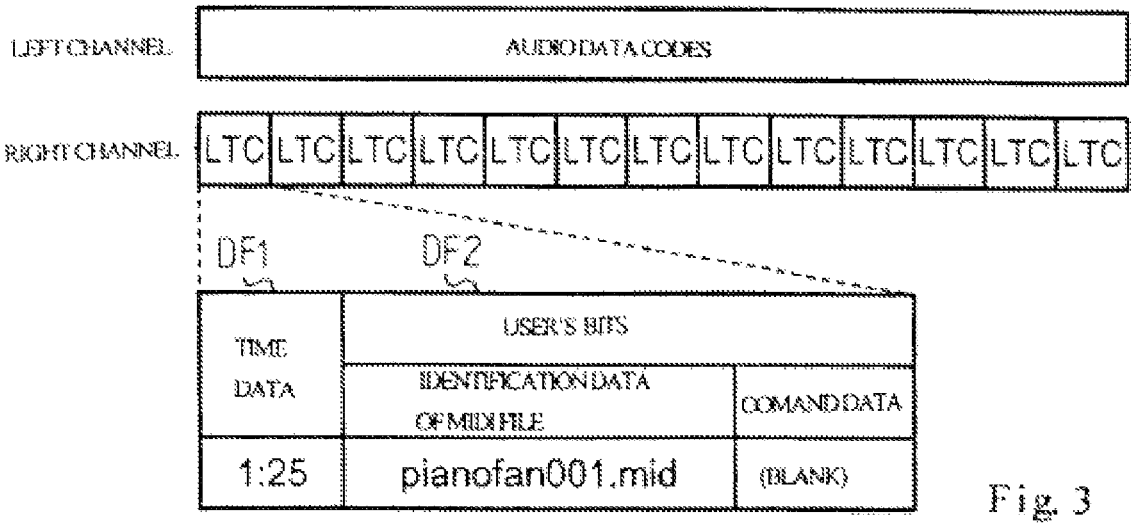
FIG. 3 is a view showing a file format of an audio data file.

An audio system embodying the present invention is used in reproduction of a music tune, and largely comprises a communication channel, an signal producing apparatus and a sound reproducing apparatus. The signal producing apparatus is connected to the sound reproducing apparatus through the communication channel, and an audio signal and a quasi audio signal are supplied from the signal producing apparatus to the sound reproducing apparatus through the communication channel. A user uses the signal producing apparatus for reproducing sound of the music tune in collaboration with the sound reproducing apparatus, and uses the signal producing apparatus as a remote controller for the sound reproducing apparatus.

The signal producing apparatus includes a storage unit, a signal producing unit and a communication unit. The storage unit is connected to the signal producing unit, and the signal producing unit is connected to the communication unit, which in turn is connected to the communication channel.

At least one audio data file and at least one command file are stored in the storage unit. The audio data file has data blocks assigned to pieces of audio data and other data blocks assigned to pieces of other sorts of data. The pieces of audio data express sound to be reproduced. The command file has data blocks corresponding to the data blocks of audio file and other data blocks corresponding to the other data blocks of audio file, and the other data blocks of the command file are assigned to at least one piece of command data. The piece of command data expresses a command to the sound reproducing apparatus.

The signal producing unit produces the audio signal from the pieces of audio data and the pieces of other sort of data in the audio data file, and the quasi audio signal from the piece of command data in the command file. The audio signal and quasi audio signal are transferred from the signal producing unit to the communication unit, and the communication unit delivers the audio signal and quasi audio signal to the communication channel.

The sound producing apparatus includes a communication unit, a signal-to-sound converter and a command restorer. The communication unit is connected to the communication channel, and is further connected to the signal-to-sound converter and command restorer. The command restorer is further connected to the signal-to-sound converter.

The communication unit receives the audio signal and quasi audio signal, and the audio signal and quasi audio signal are respectively supplied to the signal-to-sound converter and the command restorer. The command restorer restores the quasi audio signal to the command, and supplies the command to the signal-to-sound converter. The signal-to-sound converter is responsive to the command so as to convert the audio signal to the sound.

When a user wishes to reproduce the music tune through the sound reproducing apparatus alone, the user uses the signal producing apparatus as a remote controller. The user gives the signal producing apparatus an instruction for the playback through the sound reproducing apparatus alone. Then, the signal producing unit reads out the piece of command data from the command file, and producing the quasi audio signal from the piece of command data. The command expresses "play on the music tune", "stop of playback", "pause of playback", etc., and the signal-to-sound converter produces the sound of music tune on the basis of pieces of music data stored in a music data file under the control of signal producing apparatus. Thus, the signal producing apparatus serves as the remote controller for the sound reproducing apparatus.

On the other hand, when a user wishes to reproduce the music tune in collaboration between the signal producing apparatus and the sound reproducing apparatus, the signal producing apparatus produces at least the audio signal from the pieces of audio data in the audio data file, and supplies the audio signal to the sound reproducing apparatus through the communication channel. The music data file is specified with one of the pieces of other sorts of data or the quasi audio signal. The sound reproducing produces at least part of sound from the audio signal and at least other part of sound on the basis of the pieces of music data stored in the music data file. Thus, the music tune is reproduced in collaboration between the signal producing apparatus and the sound reproducing apparatus.

In case where the signal producing apparatus further includes a signal-to-sound converter, the part of sound may be produced through the signal-to-sound converter of the signal producing apparatus instead of the sound reproducing apparatus.

As will be appreciated from the foregoing description, user's command is given to the sound reproducing apparatus without any remote controller physically independent of the signal producing apparatus. For this reason, a manufacturer can reduce the production cost of audio system of the present invention.

In the following description, term "front" is indicative of a position closer to a human player, who is sitting on a stool for fingering, than a position modified with term "rear". "Longitudinal direction" extends in a direction passing through a front position and a corresponding rear position, and "lateral direction" crosses the longitudinal direction at right angle. "Up-and-down direction" is normal to a plane defined by the longitudinal direction and lateral direction.

First Embodiment

Referring first to FIG. 1 of the drawings, an audio system 100 embodying the present invention largely comprises a portable music player 10 and an automatic player musical instrument 20, and the portable music player 10 is connected to the automatic player musical instrument 20 through a cable 30 such as, for example, a USB cable.

The portable music player 10 has an information processing capability, and plural sets of audio data codes, i.e., plural audio data files 14*c*, command files 14*b* and a computer program 14*a* are stored in the portable music player 10. (See FIG. 2)

Discrete values are sampled from the waveform of an audio signal expressing a music tune at 44.1 KHz, and are digitized into the audio data codes. All the discrete values sampled from the audio signal expressing a music tune are stored in one of the music data files 14*c* in the form of audio data codes together with time data codes expressing the lapse of time from the initiation of playback.

Each of the command files 14*b* is similar in file structure to the music data files 14*c*, and the command data codes in the command file express commands corresponding to user's instructions to the automatic player musical instrument 20. As will be hereinlater described in detail, particular bits in the time data codes express the command to the automatic player musical instrument 20.

The audio data files 14*c* and command files 14*b* are supplied to the portable music player 10 from various data source. The audio data files 14*c* and/or command files 14*b* are, by way of example, downloaded from a server computer (not shown) to the portable music player 10. Otherwise, the audio data files 14*c* and/or command files 14*b* are transferred from a personal computer system (not shown) to the portable music player 10.

The automatic player musical instrument 20 is a combination of an acoustic upright piano 20*a* and an automatic playing system 20*b*. The automatic playing system 20*b* is responsive to the commands so as to perform music tunes on the acoustic upright piano 20*a* in various modes of operation without any fingering of a human player.

A user directly gives his or her instructions to the portable music player 10, and the portable music player 10 differently behaves depending upon the tasks given by the user. When the user instructs the portable music player 10 to reproduce electric tones of a music tune, the audio data file is specified, and audio data codes are restored to the audio signal expressing the music tune. The audio signal is converted to the electric tones along the music tune.

On the other hand, when a user gives the portable music player 10 an instruction to control the automatic player musical instrument 20, the command file 14*b* corresponding to user's instruction is opened, and the command data codes are read out from the command file 14*b*. The portable audio player 10 produces a quasi audio signal from the command data codes, and is transferred from the portable audio player 10 to the automatic player musical instrument 20 through the cable 30. The automatic player musical instrument 20 determines tasks to be achieved on the basis of the command represented by the quasi audio signal, and accesses a music data file for the automatic playing. The music data codes are read out from the music data file, and the automatic player musical instrument 20 produces acoustic tones or electronic tones on the basis of the music data codes of the music tune.

The portable audio player 10 and automatic player musical instrument 20 are assumed to have an audio data file expressing a music tune and a music data file expressing the same music tune, respectively. When the user instructs the portable music player 10 to reproduce a music tune on the basis of a music data file and an audio data file, the portable audio player 10 specified the audio data file, and produces the audio signal expressing the audio data codes and the corresponding music data file. The audio signal is supplied from the portable audio player 10 to the automatic player musical instrument. The automatic player musical instrument 20 specifies the music data file so as to start to produce the acoustic piano tones or electronic tones, and restores the audio data codes to the audio signal. The automatic player musical instrument 20 produces either acoustic piano tones or electronic tones together with the electric tones. Thus, the automatic player musical instrument 20 performs the music tune in collaboration with the portable audio player 10.

Portable Audio Player

FIG. 2 shows the electronic system configuration of the portable audio player 10. The portable audio player 10 includes a control module 11, a communication module 13, a storage unit 14, a manipulating panel 15, a display panel 16, a sound system 17 and an internal bus system 18. The control module 11, communication module 13, storage unit 14, manipulating panel 15, display panel 16 and sound system 17 are connected to the internal bus system 18 so that the control module 11 is communicable with the communication module 13, storage unit 14, manipulating panel 15, display panel 16 and sound system 17 through the internal bus system 18.

The control module 11 includes an information processing system, and the information processing system has a central processing unit, peripheral processors, read only memory devices and random access memory device. The computer program 14*a*, which is transferred from the storage unit 14, runs on the central processing unit so as to achieve given tasks. The computer program is broken down into a main routine program and subroutine programs, and one of the subroutine programs is prepared for the playback of music tunes and remote control on the automatic player musical instrument 20.

The communication module 13 includes an USB interface and a radio transmitter and receiver so that the control module 11 communicates with the automatic player musical instrument 20 through the communication module 13. When a user wishes to download the audio data files 14*c* and command files 14*b* from a server computer or a personal computer, the communication module 13 is connected to a communication network, to which the server computer is connected, or the personal computer through the cable 30 or a radio channel.

The manipulating panel 15 includes an array of control switches and ten keys and a mouse so that users give his or her instructions and intentions to the control module 11. On the other hand, the display panel 16 is implemented by a liquid crystal display panel, and produces various visual images expressing a menu, prompt messages, current status and so forth. Thus, the manipulating panel 15 and display panel 16 make it possible to have dialogue between the users and the control module 11.

The storage unit 14 has a huge storage capacity. In this instance, the storage unit 14 is implemented by a hard disc unit. The computer program 14*a*, command files 14*b* and audio data files 14*c* are stored in the storage unit 14. When the portable audio player 10 is powered on, the instruction codes of computer program 14*a* are transferred from the storage unit 14 to the control module 11, and the main routine program starts to run on the central processing unit. When the user instructs the control module the playback or remote control, the main routine program starts periodically branch to the subroutine program for the playback and remote control.

As described hereinbefore, sets of audio data codes, which express music tunes, respectively, are stored in the audio data files 14*c*, and discrete values, which are sampled at 44.1 kHz from the waveform of audio signal, are digitized into each set of the audio data codes. A file format of the audio data files 14*c* is hereinlater described. While the subroutine program for the playback and remote control is running on the central processing unit, the audio data codes in the audio data file 14*c* are restored to the audio signal, and the audio signal is converted to the tones of music tune by means of the sound system 17.

The command files 14*b* have the file format same as that of the audio data files 14*c*. When a user instructs the portable audio player 10 to serve as the remote controller for the automatic player musical instrument 20, the main routine program also starts periodically to branch the subroutine program for the playback and remote control. While the subroutine program for the playback and remote control is running on the central processing unit, the command data codes in the command file are converted to the quasi audio signal, and the quasi audio signal is transferred from the communication module 13 through the cable 30 to the automatic player musical instrument 20. Since the command data codes in the command files 14*b* express tasks to be achieved in accordance with user's instruction, neither music sound nor voice is not produced from the quasi audio signal.

File Format

Turning to FIG. 3, the file format of audio data files 14*c* is illustrated. Certain data blocks are assigned to the left channel, and audio data codes are stored in the certain data blocks. Other data blocks are assigned to the right channel, and longitudinal time codes LTC are stored in these data blocks at time intervals of 30 milliseconds. The longitudinal time codes LTC are defined in SMPTC (Society of Motion Picture and Television Engineers) protocols, and each of the longitudinal time codes LTC has a time data filed DF1 assigned to a time data code and a user's data filed DF2.

The time data code expresses a piece of time data, and the piece of time data is indicative of the lapse of time from the audio data code at the head of the audio data file, i.e., the lapse of time from the initiation of playback. The piece of time data shown in FIG. 3 is indicative of one minute and twenty-five seconds from the initiation of playback.

The user's data field DF2 has 32 bits, and the user's bits express a piece of identification data and a piece of command data. The pieces of identification data are respectively assigned to the music data files so that a user, control module 11 and automatic playing system can identify a music data file with each of the pieces of identification data. In the user's filed shown in FIG. 3, the piece of identification data is indicative of the file name "pianofan001.mid" of a music data file, and the piece of command data is not indicative of any command because of the usage in the playback. For this reason, the user's bits for the command data are labeled with "blank" in FIG. 3.

Figure 4:
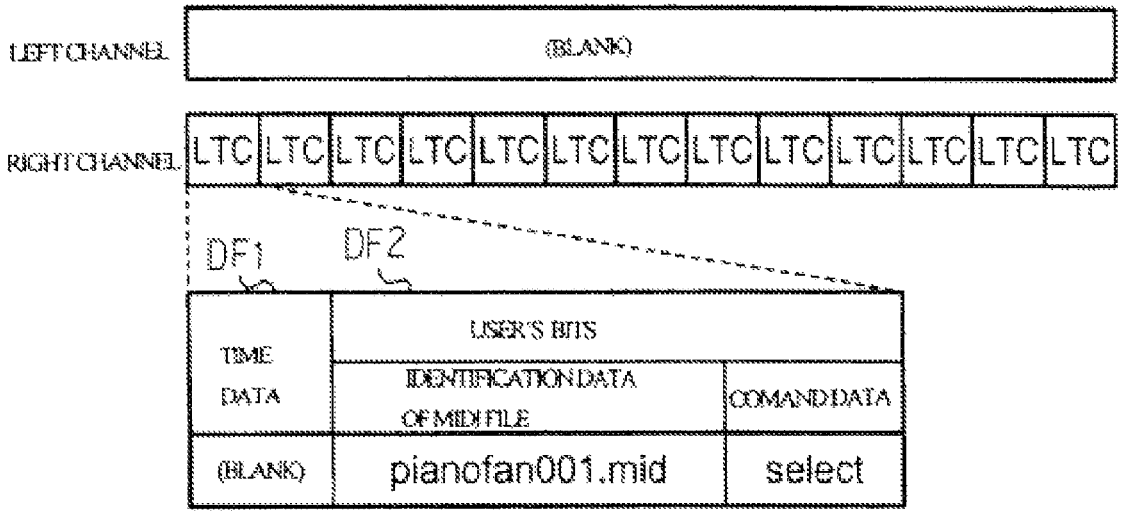
FIG. 4 is a view showing a file format of a command file.

FIG. 4 shows the file format of the command files 14*b*. The certain data blocks and other data blocks are also assigned to the left channel and right channel, respectively. Since the command files 14*b* are opened for the remote control on the automatic player musical instrument 20, neither music sound nor voice is not required, and the meaningless bits are stored in the data blocks for the left channel. Accordingly, the data blocks for the left channel are labeled with "blank" in FIG. 4. The longitudinal time codes LTC are stored in the data blocks for the right channel at time intervals of 30 milliseconds as similar to the audio data files 14*c*. Nevertheless, it is not necessary to indicate the lapse of time for the remote control on the automatic player musical instrument 20. For this reason, the time data field DF1 is labeled with "blank". On the other hand, the piece of identification data and the piece of command data are stored in the users data field DF2. In the longitudinal time codes shown in FIG. 4, the piece of identification data is indicative of the file name "pianofan001.mid" of music data file, and the piece of command data is indicative of a command "select". The command "select" makes the automatic playing system 20*b* open the music data file specified by the piece of identification code "pianofan001.mid".

Figure 5:
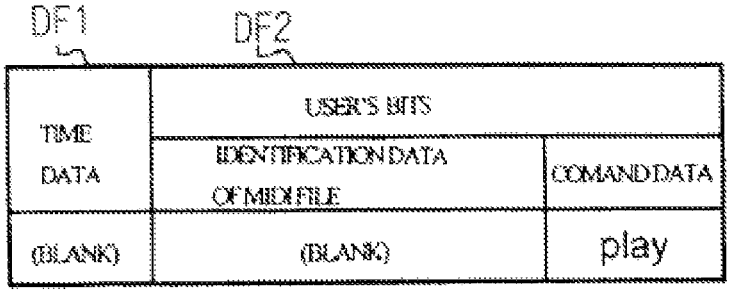
FIG. 5 is a format of a longitudinal time code in the command file.

FIG. 5 shows a longitudinal time code LTC stored in another command file. The piece of time data in the time data field DF1 does not indicate any lapse of time so that the time data filed DF1 is labeled with "blank". The piece of command data "play" makes the automatic playing system 20*b* start to perform a piece of music. Since the music data file has been chosen by the user through another command data code "select", the user's data filed DF2 is labeled with "blank".

In order to transfer the command to the automatic playing system 20*b*, the control module 11 respectively produces the audio signal representative of the silence and quasi audio signal representative of the piece of identification data and piece of command data from the audio data codes in the data blocks for the left channel and the longitudinal time codes LTC in the data blocks for the right channel through the execution of subroutine program for the playback and remote control, and the audio signal and quasi audio signal are supplied from the communication module 13 through the cable 30 to the automatic playing system 20*b*. Any sound is not produced from the audio signal. However, the quasi audio signal is restored to the piece of identification data and piece of command data, and the automatic playing system 20*b* starts to achieve the tasks expressed by the piece of command data.

In this instance, each of the command file is prepared for a single command. In other words, plural command files, which are equal in number to the commands, are required for the automatic playing system 20*b*. FIG. 6 shows various command files CF1, CF2, CF3, CF4, CF5, CF6, CF7, CF8, CF9, CF10, . . . . The command file CF1 is opened for initiation of a performance through the automatic playing, and the command is expressed as "play". The command file CF2 is prepared for termination of the performance, and the command is expressed as "stop". The command file CF3 is prepared for interruption of the performance, and the command is expressed as "pause". The command file CF4 is opened to advance the performance at high speed, and the command is expressed as "ff". The command file CF5 is used to reverse the performance, and the command is expressed as "rew". When a user wishes to record a performance on the acoustic piano 20*a*, the command file CF6 is opened, and the command "rec" is written in the user's data filed DF2.

As will be hereinlater described, the automatic playing musical instrument 20 permits a player to perform a music tune through electronic tones and the acoustic tones. When the player chooses the electronic tones, the acoustic piano 20*b* is prohibited from producing the acoustic tones, and produces the electronic tones instead of the acoustic tones. The command file CF7 is opened for the performance through the electronic tones, and command "silent" is written in the users data field DF2. On the other hand, when the player wishes to perform a music tune through the acoustic piano tones, he or she opens the command file CF8 for the performance through the acoustic piano tones, and the command is expressed as "acoustic".

The command files CF9, CF10, . . . are prepared for the music data files "pianofan001.md", "pianofan002.mid", . . . . The music data files are respectively named as "pianofan001.mid", "pianofan002.mid", . . . and users specify a music data file with the command files CF9, CF10, . . . .

Automatic Player Musical Instrument

Figure 7A:
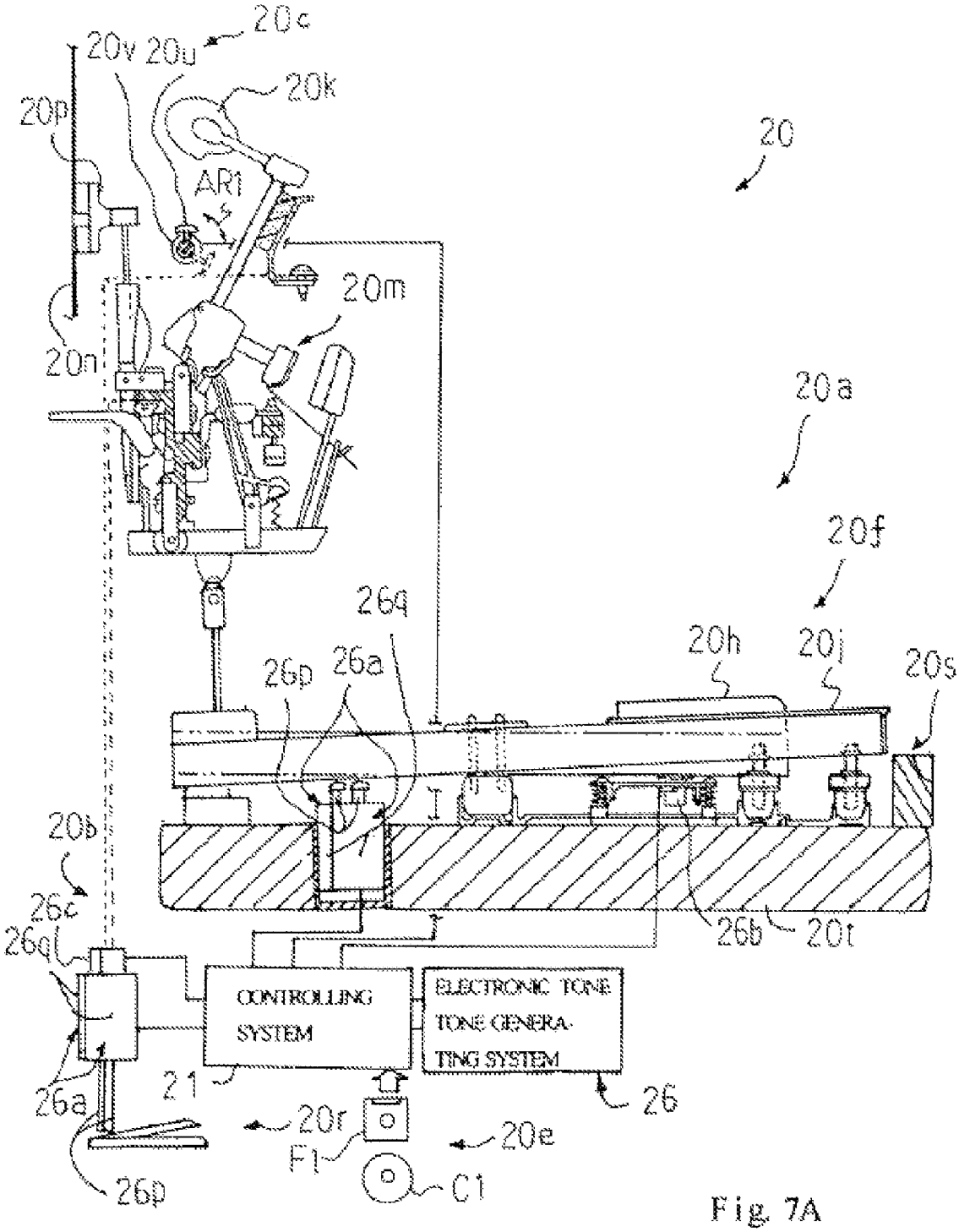
FIG. 7A is a cross sectional view showing the structure of an automatic player musical instrument forming a part of the audio system.

Turning to FIG. 7A of the drawings, the automatic player musical instrument 20 includes not only the acoustic piano 20*a* and automatic playing system 20*b* but also a muting system 20*c*, an electronic tone generating system 26 and a recording system 20*e*. The automatic playing system 20*b* is responsive to the music data codes in the music data files so as to perform music tunes on the acoustic piano 20*a* without any fingering of a human player. The muting system 20*c* permits the acoustic piano to produce the acoustic piano tones, and prohibits it from producing the acoustic piano tones. The electronic tone generating system 26 produces the electronic tones during the fingering on the acoustic piano 20*a* and on the basis of the music data codes in the music data files. The recording system 20*e* produces music data codes during the performance on the acoustic piano 20*a*, and the music data codes form a new music data file.

The acoustic piano 20*a* includes a keyboard 20*f*, i.e., an array of black keys 20*h* and white keys 20*j*, hammers 20*k*, action units 20*m*, strings 20*n*, dampers 20*p*, a pedal mechanism 20*r* and a piano cabinet 20*s*. The keyboard 20*f* is mounted on a key bed 20*t*, which forms a bottom part of the piano cabinet 20*s*, and the hammers 20*k*, action units 20*m*, strings 20*n* and dampers 20*p* are provided inside the piano cabinet 20*s*.

The black keys 20*h* and white keys 20*j* are arrayed in the lateral direction, and are linked with the action units 20*m* at the rear portions thereof, and the action units 20*m* are linked with the dampers 20*p* at the rear portions thereof. While force is being exerted on the front portions of keys 20*h* and 20*j*, the black keys 20*h* and white keys 20*j* travel from rest positions to end positions along loci, and the black keys 20*h* and white keys 20*j* actuate the associated action units 20*m*. The action units 20*m* are same as those of a standard upright piano, and the structure and behavior of action units 20*m* are well known to persons skilled in the art. For this reason, the action units 20*m* are not detailed for the sake of simplicity.

The action units 20*m* are further linked with the hammers 20*k*, and the hammers 20*k* are opposed to the strings 20*n*. Thus, the motion of keys 20*h* and 20*j* is transmitted through the action units 20*m* to the hammers 20*m* so that a human player and the automatic playing system 20*b* drive the hammers 20*k* by depressing and releasing the black keys 20*h* and white keys 20*j*.

The action units 20*m* make the dampers 20*p* spaced from and brought into contact with the strings 20*n* depending upon the key positions on the loci of keys 20*h*/20*j*. While the dampers 20*p* are being spaced from the strings 20*n*, the strings 20*n* vibrate at the collision with the hammers 20*k*. When the dampers 20*p* are brought into contact with the vibrating strings 20*n*, the vibrations of strings 20*n* are absorbed, and the acoustic tones are decayed. While the black keys 20*h* and white keys 20*j* travels on the loci from the rest positions toward the end positions, the action units 20*m* make the associated dampers 20*p* spaced from the strings 20*n*. When the black keys 20*h* and white keys 20*j* pass certain points on the loci toward the rest positions, the action units 20*m* permit the associated dampers 20*p* to be brought into contact with the vibrating strings 20*n*.

The pedal mechanism 20*r* is linked with the dampers 20*p*, and the human player and automatic playing system directly change the relative positions between the hammers 20*k* and the strings 20*n* so as to permit them to give effects to the acoustic piano tones for artificial expressions.

The muting system 20*c* includes a hammer stopper 20*u* and a stepping motor 20*v*. The hammer stopper 20*u* is provided between the hammers 20*k* and the strings 20*n*, and extends in the lateral direction. The stepping motor 20*v* gives rise to rotation of the hammer stopper 20*u* in a direction indicated by arrow AR1, and changes the hammer stopper 20*u* between a blocking position and a free position.

While the stepping motor 20*v* is keeping the hammer stopper 20*u* at the free position, the hammer stopper 20*u* is outside the loci of hammers 20*k*, and the hammer stopper 20*u* does not interfere with the movements of keys 20*h* and 20*j*. However, when a human player moves the hammer stopper 20*u* onto the loci of hammers 20*k* by means of the stepping motor 20*v*, although the action units 20*m* make the hammers 20*k* driven for rotation, the hammers 20*k* rebound on the hammer stopper 20*u* before reaching the strings 20*n*. Thus, the muting system 20*c* prevents the strings 20*n* from vibrations at the collision with the hammers 20*k*.

While all of the black keys 20*h* and white keys 20*j* are staying at the rest positions, the hammers 20*k* are spaced from the associated strings 20*n*, and the dampers 20*p* are held in contact with the strings 20*n* as shown in FIG. 7A.

When the human player depresses one of the black keys 20*h* and white keys 20*j*, the depressed key 20*h* or 20*j* starts to travel on the locus. While the depressed key 20*h* or 20*j* is traveling on the locus, the depressed key 20*h* or 20*j* actuates the associated action unit 20*m*, which in turn causes the dampers 20*p* to be spaced from the associated strings 20*n*. The actuated action unit 20*m* makes the hammer 20*k* driven for rotation toward the associated string 20*n* through the escape from the hammer 20*k*.

The hammer stopper 20*u* is assumed to be out of the locus of hammer 20*k*. The hammer 20*k* is brought into collision with the string 20*n* at the end of rotation, and gives rise to the vibrations of the string 20*n*. The vibrating string 20*n* in turn gives rise to the vibrations of a sound board, which forms a part of the piano cabinet 20*s*, and the acoustic piano tone is radiated from the acoustic piano 20*a*. The hammer 20*k* rebounds on the string 20*n*, and is softly engaged with the action unit 20*m*.

The loudness of acoustic piano tone is proportional to the velocity of hammer 20*k* immediately before the collision with the string 20*n*. The human player and automatic playing system 20*b* strongly depress the black keys 20*h* and white keys 20*j* so as to produce the acoustic piano tones at large loudness. On the other hand, the human player and automatic playing system gently depress the black keys 20*h* and white keys 20*j* for the acoustic piano tones at small loudness.

When the human player releases the depressed key 20*h* or 20*j*, the released key 20*h* or 20*j* starts backwardly to travel on the locus. The released key 20*h* or 20*j* and associated action unit 20*m* permit the damper 20*p* to move toward the string 20*n*, and the damper 20*p* is brought into contact with the vibrating string 20*n* so as to decay the vibrations. The released key 20*h* or 20*j* further permits the action unit 20*m* to return to the rest position shown in FIG. 7A.

When the human player and automatic playing system 20*b* give an artificial expression to the acoustic piano tones, the human player and automatic playing system 20*b* depress the pedal of the pedal mechanism 20*r*, and make the acoustic piano tone prolonged or lessened in loudness depending upon the depressed pedal.

Referring to FIG. 7B concurrently with FIG. 7A, the automatic playing system 20*d* includes a controlling system 21, solenoid-operated actuators 26*a*, key sensors 26*b* and pedal sensors 26*c*. The controlling system 21 is shared with the muting system 20*c*, electronic tone generating system 26 and recording system 20*e*, and the key sensors 26*b* are further shared with the electronic tone generating system 26 and recording system 20*e*.

The controlling system 21 includes an information processing system 21*a*, which is the origin of information processing capability, a storage unit 22, a communication module 24, a touch panel 25 and disc drivers (not shown) such as a floppy disc driver and a compact disc driver, and is connected to the storage unit 22, communication module 24, touch panel 25 and disc drivers through a shared bus system. In this instance, the storage unit 22 is implemented by a hard disc driving unit, and a computer program 22*a* and the music data files 22*b* are stored in the storage unit 22.

The communication module 24 has a USB interface and a radio transmitter and receiver. The cable 30 is connected to the communication module 24, and the portable audio player 10 transmits the audio signal and quasi audio signal from the communication module 13 through the cable 30 to the communication module 24. The communication module 24 is further connectable with the internet so that it is possible to download the music data files 22*b* from a service provider. The user may transfer the music data files 22*b* from a personal computer system through the USB interface.

The touch panel 25 is a combination between a liquid crystal display panel and a matrix switch, and serves as a man-machine interface. The information processing system 21*a* produces visual images and/or character images on the liquid crystal display panel, and the visual images and/or character images express menus, prompt messages, current status and so forth. When a menu is produced on the liquid crystal display panel, he or she pushes an area where one of the images expressing contents in the menu is produced. The area is specified by means of the matrix switch, and the information processing system 21*a* specifies his or her choice.

The electronic tone generating system 26 includes a tone generator 26*e*, a mixer 26*f*, amplifiers 26*g* and loudspeakers 26*h*. A headphone is one of the loudspeakers 26*h*. The tone generator 26*e* has waveform memories for storing pieces of waveform data, and the pieces of waveform data are selectively read out from the waveform memories on the basis of the music data codes so as to produce a digital audio signal. The digital audio signal is converted to an analog audio signal, and the analog audio signal is supplied from the tone generator 26*e* to the mixer 26*f*. If the information processing system 21*a* supplies the audio signal, which is transferred from the portable audio player 10, to the mixer 26*f*, the analog audio signal is mixed with the audio signal in the mixer 26*f*, and the mixed audio signal is equalized and amplified through the amplifiers 26*g*. The amplified audio signal is supplied from the amplifiers 26*g* to the loudspeakers 26*h*, and is converted to the electric tones and electronic tones through the loudspeakers 26*h*.

The solenoid-operated actuators 26*a* are assigned to the black keys 20*h*, white keys 20*j* and pedals of pedal mechanism 20*r*, and driving signals are selectively supplied from the controlling system 21 to the solenoid-operated actuators 26*a*. When the solenoid-operated actuators 26*a* are energized with the driving signals, the plungers 26*p* project from the associated solenoids 26*q* so as to depress the front portions of associated black keys 20*h*, front portions of white keys 20*j* and front portions of pedals. The key sensors 26*b* monitor the black keys 20*h* and white keys 20*j*, and produce key position signals expressing current key positions on the loci. The key position signals are supplied from the key sensors 26*b* to the controlling system 21. The pedal sensors 26*c* monitor the plungers 26*p*, i.e., the pedals of pedal mechanism 20*r*, and produce plunger velocity signals expressing actual plunger velocity. The plunger velocity signals are supplied from the pedal sensors 26*c* to the controlling system 21.

An internal clock 21*b* includes a quartz oscillator and frequency demultipliers, and various clocks signals are output from the frequency demultipliers. One of the clock signals is used for measuring the lapse of time.

A central processing unit, peripheral processors, a read only memory, a random access memory, signal interfaces and an internal bus system are incorporated in the information processing system 21*a*. The computer program is broken down into a main routine program and subroutine programs. While the main routine program is running on the central processing unit, users can communicate with the central processing unit through the touch panel 25, and give their instructions to the central processing unit. The main routine program branches to the subroutine programs depending upon user's instructions. One of the subroutine programs is prepared for the automatic playing, and another subroutine program is assigned to the control on the muting system. Yet another subroutine program and still another subroutine program are prepared for control on the electronic tone generating system 26 and recording of performance on the acoustic upright piano 20*a*. Yet another subroutine program is assigned to the communication with the portable audio player 10. A piano controller and a servo controller, i.e., controllers 26*d* express functions achieved during the execution of instruction codes in the subroutine program for the automatic playing as will be hereinafter described. Each of the piano controller and servo controller is hereinafter labeled with the reference sign 26*d*.

Figure 8:
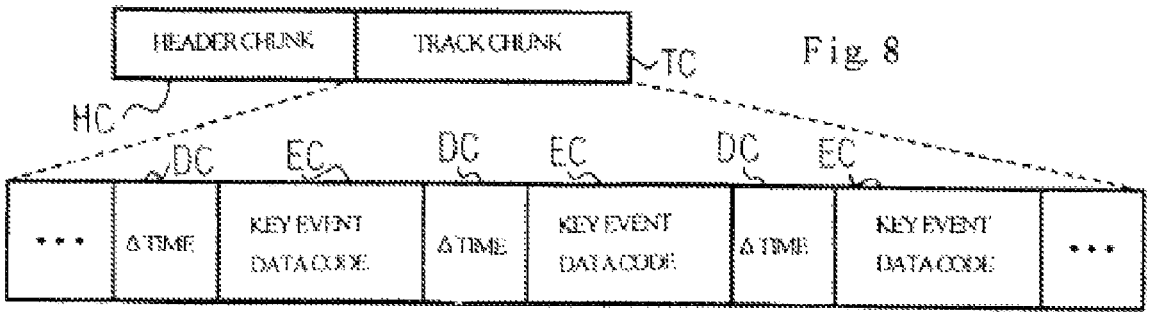
FIG. 8 is a view showing the file structure of a standard MIDI file.

FIG. 8 shows the file format of music data files 22*b*. The file format is defined in the MIDI protocols, and the music data files 22*b* are called as "standard MIDI file." The standard MIDI file is broken down into a header chunk HC and a track chunk TC, and duration data codes DC and key event data codes EC are stored in the track chunk TC. Pieces of attribute data, which express the attributes of standard MIDI file such as the title of music tune, are stored in the header chunk HC. Each of the duration data codes DC expresses a lapse of time between the key event and the next key event, i.e., delta time, and each of the key event data codes EC expresses a key event, i.e., a note-on key event or a note-off key event. Each of the key event data codes has a status byte SB and a data byte or data bytes DB. The status byte expresses the note-on key event or note-off key event, and the data bytes express the note number and velocity. A tone is produced in the note-on key event, and the tone is decayed in the note-off key event. The note number expresses the pitch of tone, and the velocity is equivalent to the loudness of tone.

While the automatic playing system 20*b* or electronic tone generating system 26 is performing a music tune on the basis of the music data codes in the music data file 22*b* in collaboration with the portable audio player 10, the time periods expressed by the duration data codes are accumulated, and the accumulated time period is compared with the lapse of time expressed by the longitudinal time codes LTC for the timing to occur the key events so that the music tune is performed in good ensemble through the acoustic piano tones/electronic tones and the electric tones.

Turning back to FIGS. 7A and 7B, again, the subroutine programs make the automatic player musical instrument 20 behave as follows.

Assuming now that a user instructs the controlling system 21 to perform a music tune, the music data codes are transferred from the track chunk TC to the random access memory, and the main routine program starts periodically to branch the subroutine program for the automatic playing.

While the subroutine program for the automatic playing is running on the central processing unit, the piano controller 26*d* measures the lapse of time from the previous key event expressed by the duration data codes DC, and determines reference forward key trajectories for the black keys 20*h* to be depressed and white keys 20*j* to be depressed.

The reference forward key trajectory is a series of values of target key position varied with time. If the black key 20*h* or white key 20*j* travels on the reference forward key trajectory, the black key 20*h* or white key 20*j* passes a reference point at a target value of reference key velocity. The key velocity at the reference key point is well proportional to the hammer velocity immediately before the collision with the string 20*n*, and the hammer velocity immediately before the collision in turn is well proportional to the loudness of tone. For this reason, it is possible to control the loudness of tones by using the reference forward key trajectory.

When the time to make the black key 20*h* or white key 20*j* start comes, the piano controller 26*d* starts to supply the target values of key position on the reference forward key trajectory to the servo controller 26*d*. The servo controller 26*d* calculates a target key velocity on the basis of series of target key position on the reference forward key trajectory. The actual key position is expressed by the key position signal, and the plunger velocity is equivalent to the actual key velocity.

The servo controller 26*d* compares the target key position and target key velocity with the actual key position and actual key velocity to see whether or not any difference is found between the target key position and the actual key position and between the target key velocity and the actual key velocity. While the black key 20*h* or white key 20*j* is exactly traveling on the reference forward key trajectory, the differences are approximately equal to zero. However, the difference or differences are found on the condition that the black key 20*h* or white key 20*j* is deviated from the reference forward key trajectory. When the servo controller 26*d* finds the difference or differences, the servo controller 26*d* determines a target value of the mean current for the driving signal in such a manner as to minimize the difference or differences, and adjusts the driving signal to the target value.

The above-described control sequence is periodically repeated. As a result, the black key 20*h* or white key 20*j* is forced to travel on the reference forward key velocity, and passes the reference point at the reference key velocity. The solenoid-operated key actuator 26*a* makes the black key 20*h* or white key 20*j* moved from the rest position toward the end position, and causes the key action unit 20*m* to drive the hammer 20*k* for rotation toward the string 20*n*. Since the hammer 20*k* is brought into collision with the string 20*n* at the target value of hammer velocity proportional to the reference key velocity, the acoustic piano tone is produced at the target value of loudness equivalent to the velocity stored in the key event data code EC.

The time to process the note-off key event data code is assumed to come. The piano controller 26*d* determines a reference backward key trajectory on the basis of the piece of note-off event data. The reference backward key trajectory is a series of values of target key position toward the rest position. If the black key 20*h* or white key 20*j* travels on the reference backward key trajectory, the released key 20*h*/20*j* permits the damper 20*p* to be brought into contact with the vibrating string 20*n* at the time to make the note-off event occur, and the acoustic piano tone is decayed. The values of target key position are periodically supplied from the piano controller 26*d* to the servo controller 26*d*, and the servo controller 26*d* forces the released key 20*h*/20*j* to travel on the reference backward key trajectory. As a result, the damper 20*p* is brought into contact with the string 20*n* so as to decay the acoustic piano tone at the time to decay it.

The servo controller 26*d*, solenoid-operated key actuators 26*a*, key sensors 26*b* and pedal sensors 26*c* form a feedback control loop for the black keys 20*h* and white keys 20*j*, and the piano controller 26*d* drives the black keys 20*h* and white keys 20*j* for the note-on key events and note-off key events expressed by the key event data codes ED through the feedback control loop. The acoustic piano tones are produced and decayed along the music tune. Thus, the automatic playing system 20*b* makes the note-on key events and note-off key events sequentially occur as defined in the music data codes.

The quasi audio signal is assumed to arrive at the communication module 24. The quasi audio signal was produced from the command data codes in the mute command file CF7, and requests the muting system 20*c* to change the hammer stopper 20*u* to the blocking position. The main routine program branches to the subroutine program for communication with the portable audio player, and the quasi audio signal is restored to the command data codes expressing the change to the blocking position.

When the quasi audio signal is restored to the command data codes, the subroutine program for control on the muting system starts to run on the central processing unit. The information processing system 21*a* determines the current position of hammer stopper 20*u*, and calculates target angle over which the hammer stopper 20*u* is to be rotated. The information processing system 21*a* supplies a driving signal to the stepping motor 20*v* so that the hammer stopper 20*u* is rotated over the target angle. Thus, the hammer stopper 20*u* is moved to the blocking position on the loci of hammers 20*k*.

While the hammer stopper 20*u* is staying at the blocking position, the hammers 20*k* rebound on the hammer stopper 20*u* after the escape and before the collision with the strings 20*n*, and the vibrations do not take place.

When the hammer stopper 20*u* reaches the blocking position, the main routine program periodically branches to the subroutine program for control on the electronic tone generating system. While the subroutine program for control on the electronic tone generating system is running on the central processing unit, the depressed keys 20*h*/20*j*, released keys 20*h*/20*j* and strokes of pedals from the rest positions are determined, and the music data codes are produced so that the electronic tone generating system 26 produces the electronic tones on the basis of the music data codes.

When a user instructs the portable audio player 10 to makes the hammer stopper 20*u* changed to the free position, the acoustic command file CF8 is opened, and the quasi audio signal is produced from the command data codes in the command file CF8. The quasi audio signal is transferred from the communication module 13 to the communication module 24, and is restored to the command data codes through the execution of instruction codes of subroutine program for communication with the portable audio player. The subroutine program for control on the muting system starts to run on the central processing unit. The current position of hammer stopper 20*u* and target angle over which the hammer stopper 20*u* is to be rotated are determined, and the driving signal is supplied from the information processing system 21*a* to the stepping motor 20*v*. The stepping motor 20*v* gives rise to the rotation of hammer stopper 20*u*, and the hammer stopper 20*u* reaches the free position at the end of rotation. The hammer stopper 20*u* is out of the loci of hammers 20*k* so that the hammers 20*k* are able to be brought into collision with the strings 20*n* for producing the acoustic piano tones.

After the change to the free position, the user requests the recording system 20*e* to record his or her performance on the acoustic upright piano 20*a* through the portable audio player 10. The quasi audio signal is produced from the command data codes in the command file CF6. The quasi audio signal is restored to the command data codes, and the main routine program starts to branch the subroutine program for recording the performance on the acoustic upright piano 20*a*.

While the human player is fingering a music tune, the key sensors 26*b* and pedal sensors 26*c* produces the key position signals and plunger velocity signals, and supplies those signals to the information processing system 21*a*. The information processing system 2 la analyzes the pieces of key position data expressed by the key position signals and the pieces of plunger velocity data expressed by the plunger velocity signals, and produces the music data codes on the basis of the pieces of key position data and pieces of plunger velocity data. The music data codes are stored in a floppy disc F1 or a compact disc C1. Otherwise, the music data codes are transmitted from the communication module 24 to another musical instrument or a server computer through the communication network.

Behavior of Audio System

Description is hereinafter made on the behavior of audio system 100 under user's instruction to reproduce a music tune only through the portable audio player 10, only through the automatic player musical instrument 20 and in collaboration between the portable audio player 10 and the automatic player musical instrument.

A user is assumed to wish to hear a music tune through the portable audio system 100. A job menu has been already produced on the display panel 16. The user selects the job for the solo playback from the job menu through the manipulating panel 15. Then, the central processing unit of control module 11 accesses the storage unit 14, and determines the title of music tunes stored in the storage unit 14. The central processing unit of control module 11 supplies a visual image signal representative of a list of music tunes to the display panel 16, and produces the list of music tunes on the display panel 16. When the user specifies one of the music tunes from the list through the manipulating panel 15, the audio data codes get ready to transfer to the random access memory of control module 11. The user instructs the central processing unit of control module 11 to start the playback through the manipulating panel 15. Then, the main routine program starts periodically to branch to the subroutine program for playback and remote control. While the subroutine program for playback and remote control is running on the central processing unit in the control module 11, the audio signal is produced from the audio data codes, and is transferred to the sound system 17. The audio signal is converted to the electric tones along the music tune through the sound system 17.

A user is assumed to wish to hear a music tune through the automatic player musical instrument 20. The portable audio player 20 behaves as a remote controller as described hereinlater on the assumption that the music data files 22*b*, which have been prepared for the music tunes expressed by the audio data files 14*c*, are found in the storage unit 22.

Figure 9:
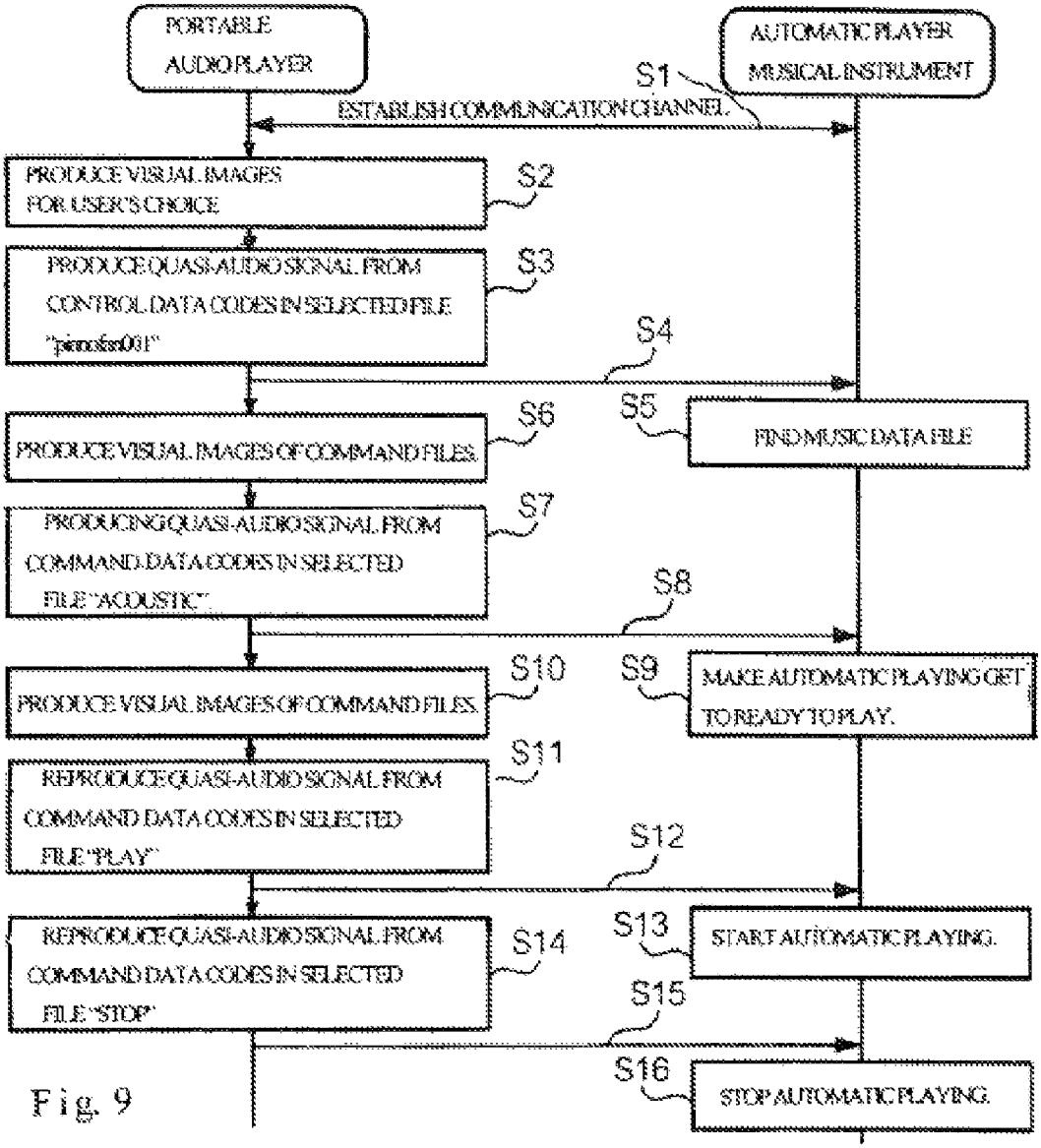
FIG. 9 is a flowchart showing a control sequence for the automatic player musical instrument through the portable audio player.

The user connects the cable 30 between the portable audio player 10 and the automatic player musical instrument 20. Then, the communication channel is established between the portable audio player 10 and the automatic player musical instrument 20 as by step S1, and the portable audio player 10 gets ready to serve as the remote controller. The user controls the automatic player musical instrument as shown in FIG. 9.

The job list has been already produced on the display panel 16. The user selects the remote control from the job menu through the manipulating panel 15. The main routine program starts periodically to branch to the subroutine program for the playback and remote control.

Figure 10:
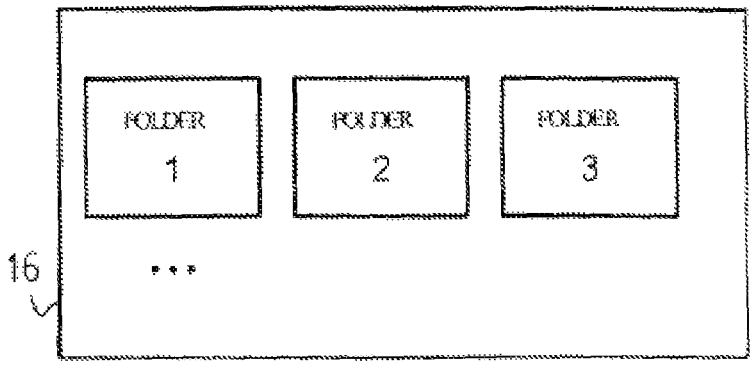
FIG. 10 is a front view showing visual images of folders produced on a display panel.

The peripheral processor of control module 11 supplies the visual image signal to the display panel 16, and produces the visual images of folders "FOLDER1", "FOLDER2", "FOLDER3", . . . on the display panel 16 as by step S2. FIG. 10 shows the visual images of folders on the display panel 16. The user wishes firstly to select a favorite music tune. The folder FOLDER3 is prepared for the music tunes. Then, the user selects the folder FOLDER3 through the manipulating panel 15.

Figure 11:
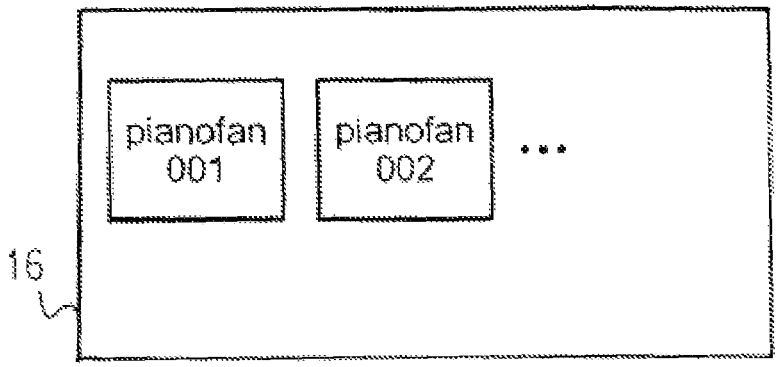
FIG. 11 is a front view showing visual images of command files for selecting a music data file.

The central processing unit of control module 11 opens the folder FOLDER3, and the peripheral processor produces the visual image signal representative of the command files. The visual image signal is supplied from the peripheral processor of control module 11 to the display panel 16 so that the visual images of command files "pianofan001", "pianofan002", . . . are produced on the display panel 16 as show in FIG. 11. The favorite music tune is assumed to be recorded in the music data file "pianofan001.mid". The user selects the command data file "pianofan001" through the manipulating panel 15. As shown in FIG. 4, the command file "pianofan001" has the blank data blocks for the left channel, and the pieces of identification data expressing "pianofan001.mid" and pieces of command data expressing "select" are stored in the data blocks for the right channel. The communication module 13 produces the quasi audio signal expressing the silence, music data file "pianofan001.mid" and command "select" from the pieces of audio data, pieces of identification data and pieces of command data, and the quasi audio signal is supplied from the communication module 13 to the communication module 24 through the cable 30 as by step S4.

The subroutine program for communication with the portable audio player runs on the central processing unit of the information processing system 21*a*. Even though the audio data codes are restored to the audio signal, the audio signal is representative of the silence, and any electric tone is not produced through the loudspeakers 26*h*.

The central processing unit of information processing system 21*a* restores the quasi audio signal to the pieces of identification data expressing "pianofan001" and pieces of command data expressing "select". The central processing unit accesses the storage unit 22, and selects the music data file "pianofan001.mid" from the music data files 22*b* as by step S5. The music data codes are transferred from the music data file "pianofan001.mid" to the random access memory of information processing system 21*a*, and the automatic playing system 20*b* gets ready to perform the music tune.

After the transmission of quasi audio signal to the communication module 24, the central processing unit of control module 11 makes the peripheral processor supply the visual image signal representative of the images of folders to the display panel 16, and the images of folders FOLDER1, FOLDER2, FOLDER3, . . . are produced on the display panel 16, again. The second folder FOLDER2 is assigned to the modes of operation "SILENCE", "ACOUSTIC", . . . , and the user selects the second folder FOLDER2 through the manipulating panel 15.

Figure 12:
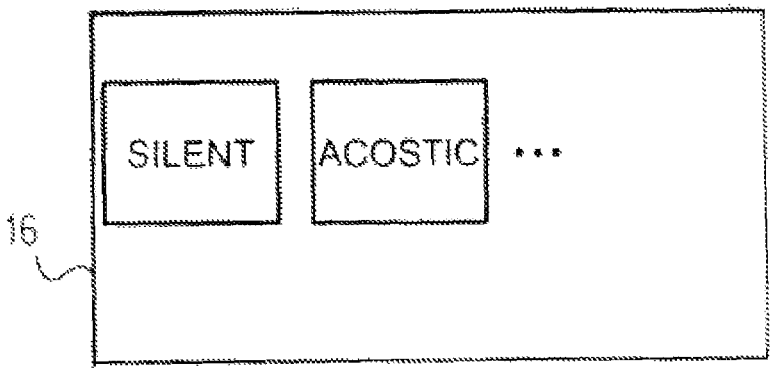
FIG. 12 is a front view showing visual images of command files for selecting modes of operation.
Figure 13:
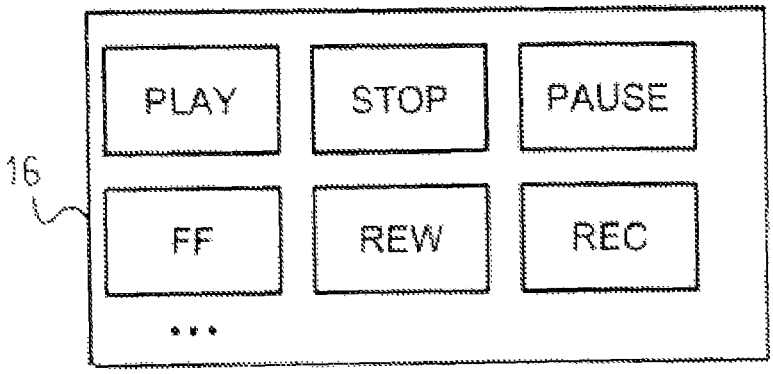
FIG. 13 is a front view showing visual images of commands for the automatic player musical instrument.

Then, the peripheral processor of control module 11 supplies the visual image signal representative of the command files for the modes of operation to the display panel 16, and the command files "SILENCE", "ACOUSTIC", . . . are produced on the display panel 16 as by step S6. FIG. 12 shows the command files for the modes of operation. The user is assumed to select the automatic playing mode from those on the screen through the manipulating panel 15.

The communication module 13 produces the quasi audio signal representative of the silence and automatic playing from the pieces of audio data and pieces of command data in the command file "acoustic" as by step S7, and the quasi audio signal is supplied from the communication module 13 to the communication module 24 as by step S8.

The central processing unit of information processing system 21*a* restores the quasi audio signal to the audio data codes expressing the silence and the piece of command data expressing the automatic playing. Then, the subroutine program for control on the muting system 20*c* starts to run, and the stepping motor 20*v* gives rise to the rotation of hammer stopper 20*u* to the free position. The acoustic upright piano 20*a* gets ready to perform the music tune as by step S9.

After the transmission of quasi audio signal to the communication module 24, the central processing unit of control module 11 makes the peripheral processor produce the visual image signal representative of the folders as shown in FIG. 10. The command files for control on the automatic playing system 20*b* are put in the first folder FOLDER1, and the user selects the first folder FOLDER1 from the visual images of folders. Then, the peripheral processor produces the visual image signal representative of the command files "play", "stop", "pause", "ff", "rew", rec", . . . , and supplies the visual image signal to the display panel 16. Then, the visual images of command files are produced on the display panel 16 as by step S10.

The user selects the command file "play" from the visual images of command files through the manipulating panel 15. The central processing unit of control module 11 makes the communication module 13 produce the quasi audio signal from the pieces of audio data expressing the silence and pieces of command data expressing the command "play" shown in FIG. 5, and the quasi audio signal is transmitted from the communication module 13 to the communication module 24 as by step S12.

The central processing unit of information processing system 21*a* restores the quasi audio signal to the pieces of audio data expressing the silence and piece of command data expressing the command "play". Then, the automatic playing system 20*b* starts to perform the music tune on the basis of the music data file "pianofan001.mid" as by step S13. The behavior of automatic playing system has been already described.

After the transmission of the quasi audio signal, the peripheral processor of control module 11 makes the display panel 16 continuously produce the visual images of command files for control on the automatic playing system. The user is assumed to select the visual image of command file "stop". Then, the communication module 13 produces the quasi audio signal from the pieces of audio data expressing the silence and pieces of command data expressing the command "stop", and the quasi audio signal is transmitted from the communication module 13 to the communication module 24 as by step S14.

The central processing unit of information processing system 21*a* restores the quasi audio signal to the pieces of audio data expressing the silence and the piece of command data expressing the command "stop". Then, the automatic playing system 20*b* stops the automatic playing as by step S16.

Thus, the user can control the automatic player musical instrument 20 through the portable audio player 10.

Figure 14:
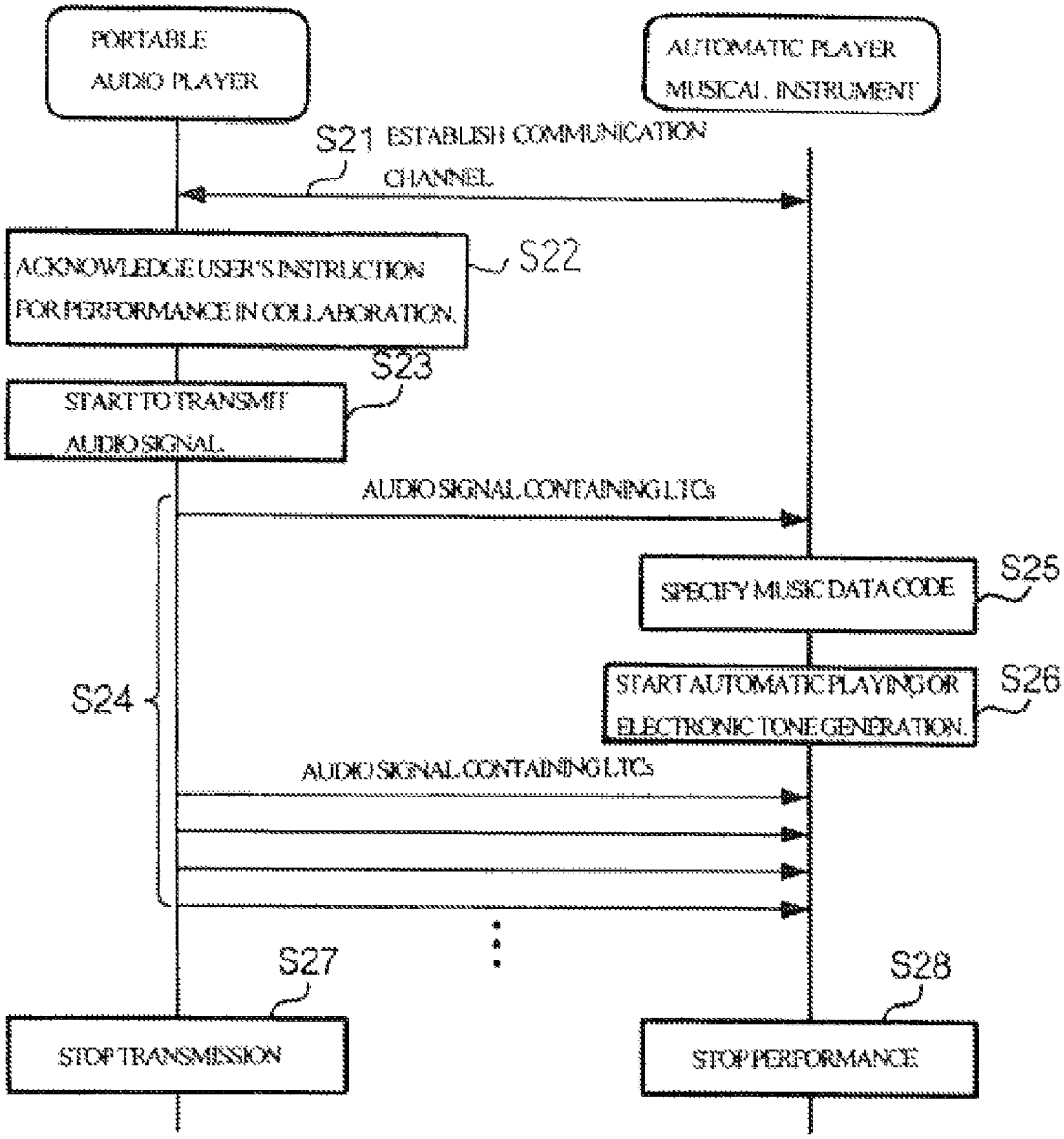
FIG. 14 is a flowchart showing a control sequence for a performance in collaboration between the automatic player musical instrument and the portable audio player.

Finally, a user is assumed to select a performance of a music tune in collaboration between the automatic player musical instrument 20 and the portable audio player 10. FIG. 14 shows a control sequence for the performance in collaboration between the automatic player musical instrument 20 and the portable audio player 10.

The user connects the portable audio player 10 with the automatic player musical instrument 20 through the cable 30 as by step S21. Subsequently, the user selects the job for the collaboration from the job menu, and specifies the audio data file where user's favorite music tune is stored. The audio data file for the favorite music tune is assumed to be corresponding to the music data file "pianofan001.mid". The central processing unit of controller 11 makes the peripheral processor transfer the audio data file corresponding to the music data file "pianofan001.mid" to the random access memory. Thus, the control module 11 acknowledges user's instruction for the performance in collaboration between the portable audio player 10 and the automatic player musical instrument 20 as by step S22.

Subsequently, the central processing unit of control module 11 makes the communication module 13 produce the audio signal from the pieces of audio data for the left channel and the pieces of time data and pieces of identification data for the left channel. (See FIG. 3.) The pieces of identification data express the music data file where the favorite music tune is stored. The communication module 13 starts to transmit the audio signal to the communication module 24 as by step S23.

The audio signal is continuously supplied from the communication module 13 to the communication module 24, and the lapse of time, which is expressed by the pieces of time data, is increased as by step S24.

The central processing unit of information processing system 21*a* restores the analog audio signal representative of the electric tones and the pieces of identification data from the audio signal for the left channel and right channel. The central processing unit specifies the music data file "pianofan001.mid" as by step S25, and makes the peripheral processor transfer the music data codes from the music data file "pianofan001.mid" to the random access memory. Thus, the automatic player musical instrument 20 gets ready to perform the music tune through either acoustic piano tones or electronic tones.

Although any piece of command data is not stored in the user's data filed of the longitudinal time codes LTC, the lapse of time is increased so that the central processing unit of information processing system 21*a* discriminates the audio data files 14*c* from the command files 14*b*. In this situation, the command "select", command "acoustic" or "silence", command "play" and command "stop" are timely produced through the execution of instruction codes in the subroutine program for communication with the portable audio player.

When the command "play" is produced, the automatic playing system 20*b* starts to perform the music tune on the acoustic upright piano 20*a* as by step S26. The analog audio signal is supplied to the mixer 26*f*, and the electric tones are produced through the loudspeakers 26*h*. Thus, the music tune is reproduced in collaboration between the portable audio player 10 and the automatic player musical instrument 20. The music data codes in the music data file "pianofan001.mid" and the corresponding audio data file may express the tones in the piano part and the tones for accompaniment.

In order to produce the acoustic piano tones/electronic tones and the electric tones in good ensemble, the duration data codes in the music data file are accumulated so as to measure the lapse of time from the initiation of automatic playing, and the lapse of time is indicated by the internal clock 21*b*. The central processing unit of information processing system 21*a* compares the lapse of time expressed by the pieces of time data with the lapse of time on the internal clock 21*b* to see whether or not both of the acoustic piano tones/electronic tones and the electric tones are timely produced. If the answer is given negative, the central processing unit sets the internal clock ahead or back. Thus, the acoustic piano tones/electronic tones and electric tones are produced in good ensemble.

When the last audio data code is converted to the audio signal, the portable audio player 10 stops the transmission of audio signal from the communication module 13 to the communication module 24 as by step S27. On the other hand, when the last audio data code is converted to the analog audio signal, the command "stop" is timely produced, and the automatic playing system 20*b* stops the automatic playing as by step S28.

As will be appreciated from the foregoing description, the pieces of identification data and pieces of command data are stored in the longitudinal time codes LTC, and the command data files 14*b* are prepared in the file format same as that of the audio data files 14*c*. As a result, the audio signal and quasi audio signal are produced from the audio data files 14*c* and command files 14*b* in the portable audio player 10, and are transmitted to the automatic player musical instrument 20. The subroutine program for playback and remote control is available for both of the audio signal and quasi audio signal. This results in simplification of the software.

Second Embodiment

Figure 15:
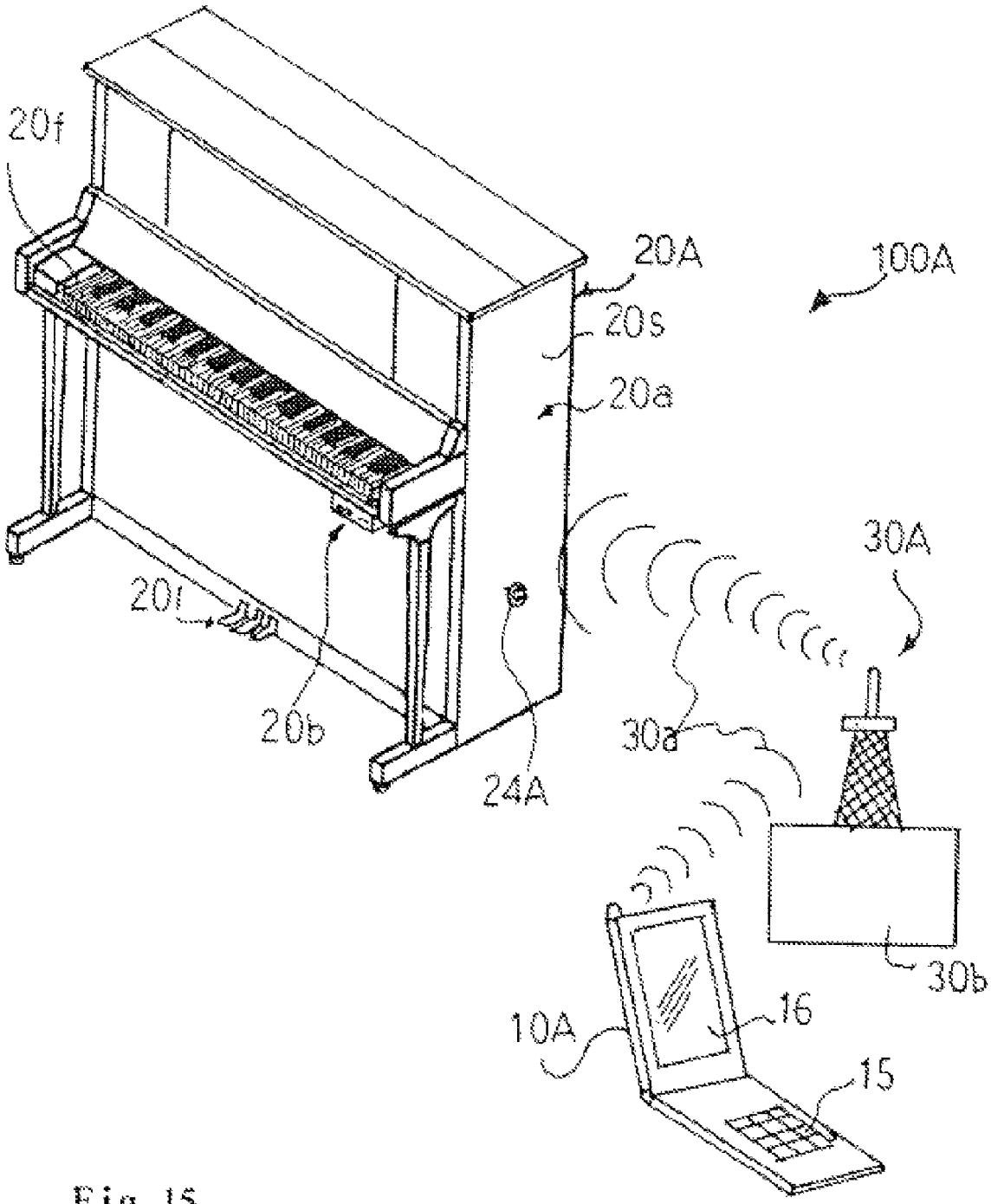
FIG. 15 is a schematic perspective view showing the system configuration of another audio system of the present invention.

Turning to FIG. 15 of the drawings, another audio system 100A largely comprises a mobile telephone 10A, an automatic player musical instrument 20A and a mobile telephone network 30A. The mobile telephone 10A includes the electronic system corresponding to the portable audio player 10, and the automatic player musical instrument 20A is similar in system configuration to the automatic player musical instrument 20 except for a communication module. The communication module of automatic player musical instrument 20A has a radio transmitter and receiver, and the radio transmitter and receiver is connected to an antenna 24A. For this reason, the component parts of mobile telephone 10A and component parts of automatic player musical instrument 20A are labeled with the reference signs designating the corresponding component parts of portable audio player 10 and corresponding component parts of automatic player musical instrument 20 without detailed description for the sake of simplicity.

The software of portable audio player 10 and software of automatic player musical instrument 20 are respectively installed in the mobile telephone 10A and automatic player musical instrument 20A, and a radio communication channel 30*a* is established between the mobile telephone 10A and a base station 30*b* and between another base station and the automatic player musical instrument 20A. The audio signal and quasi audio signal are conveyed through the radio communication channel 30*a*. For this reason, the audio system 100A achieves all the advantages of the audio system 100.

Although particular embodiments of the present invention have been shown and described, it will be apparent to those skilled in the art that various changes and modifications may be made without departing from the spirit and scope of the present invention.

In case where the portable audio player 10 communicates with the automatic player musical instrument 20 through a radio channel, the cable 30 is not connected between the portable audio player 10 and the automatic player musical instrument 20.

The portable audio player 10 and mobile telephone 10A do not set any limit to the technical scope of the present invention. For example, the portable audio player 10 or mobile telephone 10A may be replaced with a PHS (Personal Handyphone System, which is a registered trademark in Japan), a PDA (Personal Digital Assistance) or a personal computer system.

The automatic player musical instrument 20 does not set any limit to the technical scope of the present invention. The software may be installed in another sort of automatic player musical instrument such as, for example, combinations of automatic playing system and a percussion instrument, wind instrument and string instrument. Moreover, the automatic player musical instrument 20 may be replaced with an electronic musical instrument such as, for example, an electronic keyboard. Since only the electronic tones are produced through the electronic musical instrument, music tunes are performed through the electronic tones and electric tones in the collaboration between the electronic musical instrument and the portable audio player 10.

The musical instruments such as the automatic player musical instruments and electronic musical instruments do not set any limit to the technical scope of the present invention. A compact disc player, a stereo set or a television receiver may be controlled by means of the potable audio player 10, mobile telephone or personal computer system.

The audio data files 14*c*, command files 14*b* and music data files 22*b* may be supplied from a portable information storage medium such as, for example, a magnetic tape cassette, a magnetic disc, a compact disc, a floppy disc, an optical disc, an optomagnetic disc, a DVD (Digital Versatile Disc) or a RAM stick. Similarly, the computer programs may be installed into the portable audio player 10 and automatic player musical instrument 20 through the information storage medium.

Another synchronous technique such as those disclosed in Japan Patent Application laid-open No. 2003-271138 may be employed in the automatic player musical instrument 20.

The formats of longitudinal time code LTC shown in FIGS. 3 to 5 does not set any limit to the technical scope of the present invention.

First Modification

FIGS. 16A to 16D show longitudinal time codes LTC' and LTC of an audio data file. When a user instructs the portable audio player 10 to makes the automatic player musical instrument 20 perform a music tune in collaboration therebetween, the communication module 13 starts to convert the audio data codes and longitudinal time codes to the audio signal for the left and right channels.

While the audio data codes are expressing silence, the longitudinal time data codes LTC' are converted to the audio signal for the right channel. The user's data filed of longitudinal time codes LTC' expresses the commands "select" shown in FIG. 16A, command "acoustic" or "silent" (not shown) and command "play" shown in FIG. 16B. The audio signal is supplied from the communication module 13 to the communication module 24.

The central processing unit of information processing system 21*a* restores the audio signal for the right channel to those commands, and makes the automatic playing system 20*b* or electronic tone generating system 26 start to produce the acoustic piano tones or electronic tones.

Figure 16A:
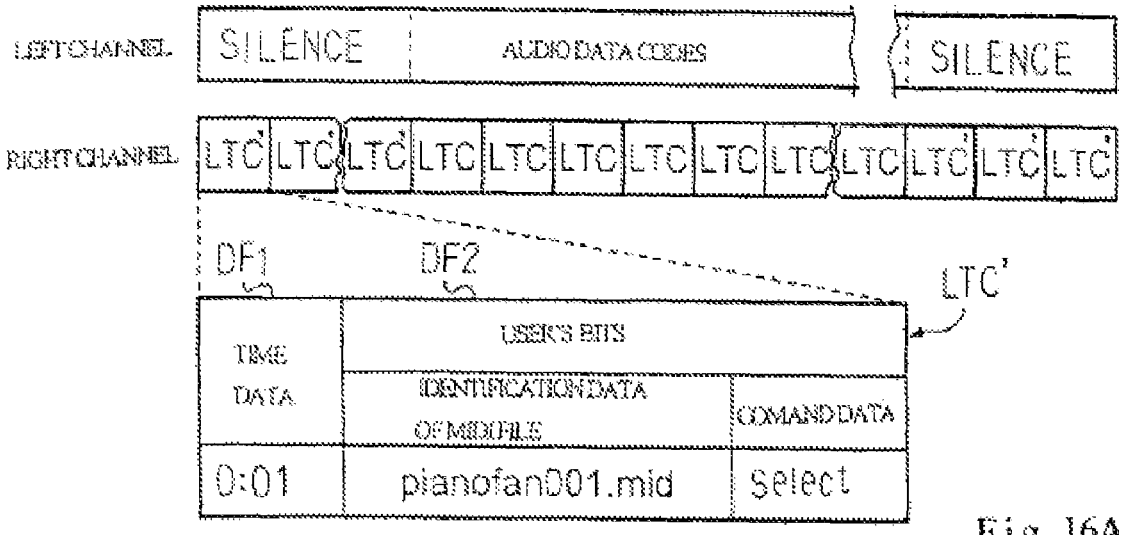
FIGS. 16A to 16D are views showing longitudinal time codes in an audio file used in a modification of the audio system.
Figure 16B:
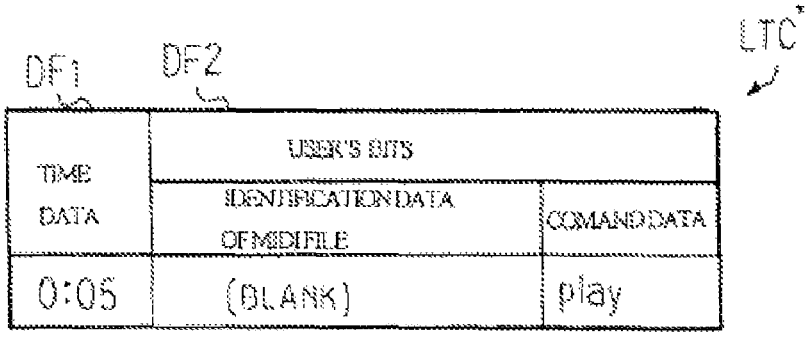
Figure 16C:
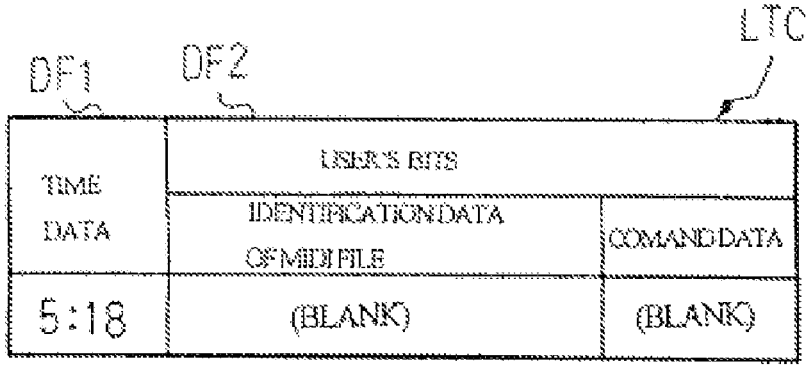

After the silent time period, the audio signal for the left channel is restored to the audio data codes, and the analog audio signal is produced from the audio data codes. However, only the pieces of time data are stored in the associated longitudinal time data codes LTC as shown in FIG. 16C. Thus, the music tune is reproduced in collaboration between the portable audio player 10 and the automatic player musical instrument 20.

Figure 16D:
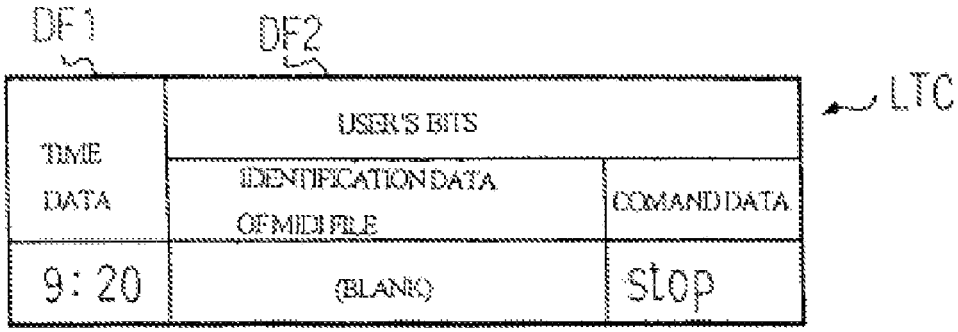
Figure 17A:
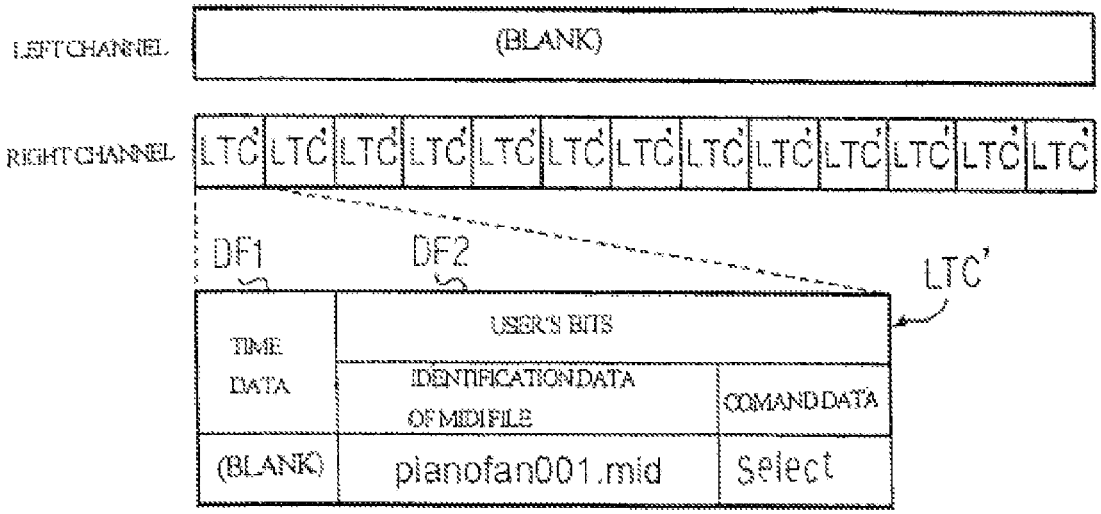
FIGS. 17A to 17D are views showing longitudinal time codes used in another modification of the audio system.
Figure 17B:
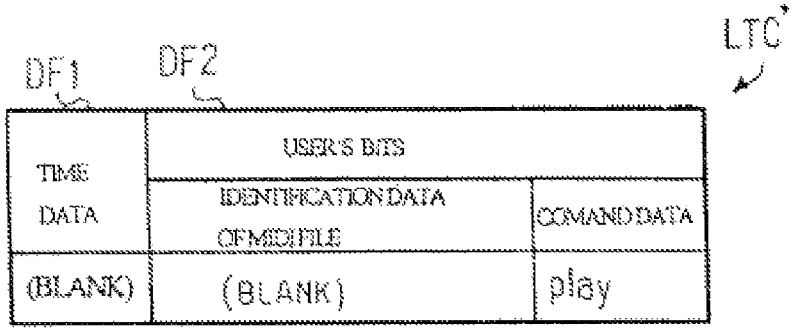
Figure 17C:
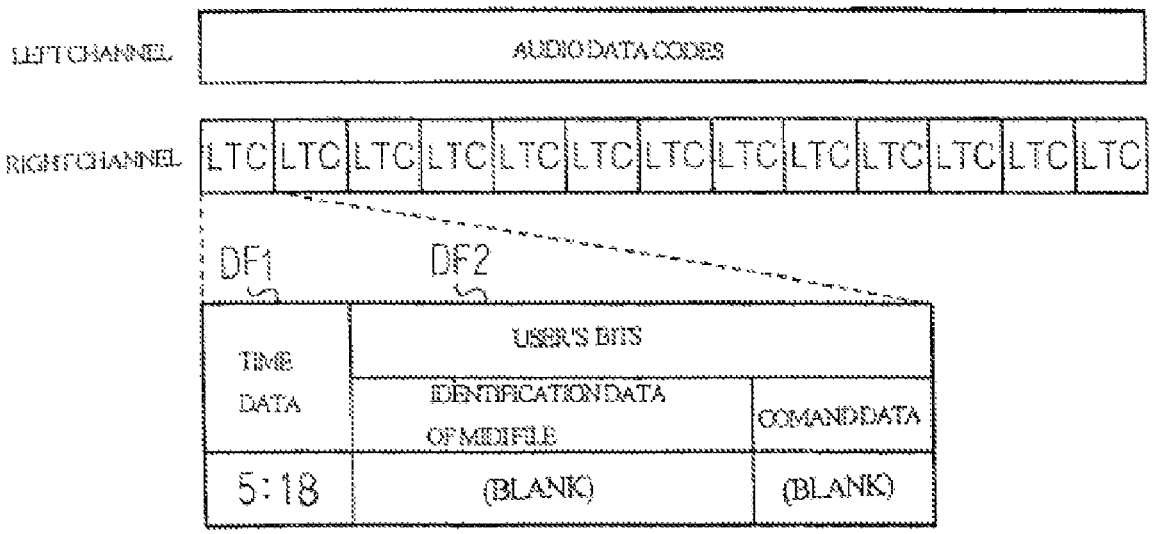
Figure 17D:
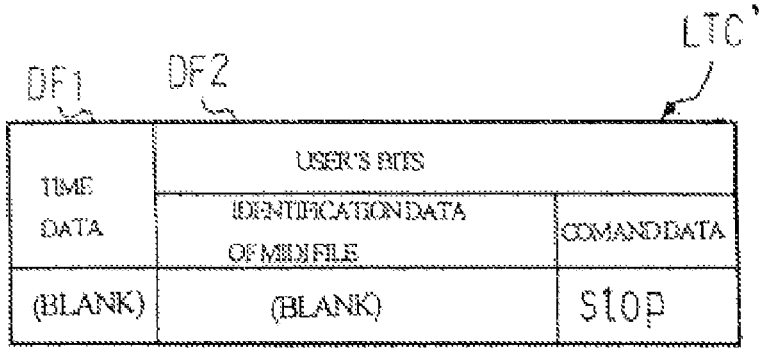

Upon completion of performance, the audio data codes express silence, and the piece of command data expressing the command "stop" is stored one of the associated longitudinal time codes LTC' shown in FIG. 16D.

Second Modification

FIGS. 17A to 17D shows the longitudinal time codes LTC' of command files and the longitudinal time codes LTC of an audio data file. When a user instructs the portable audio player 10 to perform a music tune in collaboration with the automatic player musical instrument, the central processing unit of control module 11 produces the quasi audio signal from the pieces of command data stored in the command files. First, the quasi audio signal expresses the command "select" and specified music data file "pianofan001.mid" shown in FIG. 17A. The central processing unit of information processing system 21*a* makes the peripheral processor transfer the music data codes from the specified music data file "pianofan001.mid" to the random access memory. Subsequently, the quasi audio signal expresses the command "acoustic" or "silent", and the command "play" is relayed through the quasi audio signal. The central processing unit of information processing system 21*a* changes the hammer stopper 20*u* to the free position or blocking position, and, thereafter, the automatic playing system 20*b* or electronic tone generating system 26 starts to perform the music tune.

The central processing unit of control module 11 starts to produce the audio signal from the audio data codes of audio data file corresponding to the music data file "pianofan001.mid" concurrently with the initiation of performance by means of the automatic playing system 20*b* or electronic tone generating system 26. The audio signal is transmitted from the communication module 13 to the communication module 24, and is restored to the audio data codes. The analog audio signal is produced from the audio data codes, and is converted to the electric tones through the loudspeakers 26*h*.

The above-described component parts and jobs are correlated with claim languages as follows. Each of the cable 30 and radio channel 30*a* serve as a "communication channel". The portable audio player 10 or mobile telephone 10A is corresponding to a "music data converter". The storage unit 14 and communication module 13 are respectively equivalent to a "data storage" and a "communication unit", and the control module 11 and subroutine program for playback and remote control as a whole constitute a "signal producing unit". The automatic player musical instrument 20 or 20A serves as a "sound producing apparatus". The communication module 24 and subroutine program for communication with portable audio player as a whole constitute a "communication unit", and the combination of acoustic piano 20*a*, automatic playing system 20*b* and subroutine program for automatic playing or the information processing system 21*a* and subroutine program for control on electronic tone generating system as a whole constitute a "signal-to-sound converter". The information processing system 21*a* and subroutine program for communication with portable audio player as a whole constitute a "command restorer".

The data blocks for the left channel in the audio data file are corresponding to "data blocks assigned to pieces of audio data", and the data blocks for right channel in the audio data file and data blocks for right channel in the command file are corresponding to "other data blocks assigned to other sorts of data" and "other data blocks assigned to at least one piece of command data". The pieces of time data and pieces of user's data of longitudinal time codes LTC in the audio data file serve as "pieces of other sorts of data", and the piece of command data "select", "play", "stop" etc. is corresponding to "at least one command data".

The sound system 17 serves as a "signal-to-sound converter" of the signal producing apparatus.

What is claimed is:

1. An audio system for producing a music tune, comprising:

a communication channel for propagating a digital audio signal and a device control signal identical in format with said digital audio signal therethrough;

a signal producing apparatus including a storage unit storing at least one audio data file having data blocks assigned to pieces of audio data expressing discrete values on the waveform of an analog audio signal and other data blocks assigned to pieces of other sorts of data and at least one command file having data blocks corresponding to said data blocks of said at least one audio data file and other data blocks corresponding to said other data blocks of said at least one audio data file and assigned to at least one piece of command data expressing a command, a signal producing unit connected to said storage unit and producing said digital audio signal and said device control signal from said pieces of audio data and said pieces of other sort of data in said at least one audio data file and from said at least one piece of command data in said at least one command file, and a communication unit connected to said signal producing unit and said communication channel and delivering said digital audio signal and said device control signal to said communication channel; and a sound producing apparatus including a communication unit connected to said communication channel and receiving said audio signal and said device control signal, a signal-to-sound converter connected to said communication unit and responsive to said command so as to convert said digital audio signal to said sound, and a command restorer connected to said communication unit and said signal-to-sound converter and restoring said device control signal to said at least one piece of command data so as to control said signal-to-sound converter with said command.

2. The audio system as set forth in claim 1, in which said other data blocks of said at least one audio data file have respective time data fields assigned to pieces of time data expressing lapse of time and respective user's data fields assigned to pieces of user's data.

3. The audio system as set forth in claim 2, in which one of said pieces of user's data is used for specifying a music data file storing pieces of music data for a music tune to be reproduced by means of said signal-to-sound converter.

4. The audio system as set forth in claim 3, in which said pieces of music data express at least generation of tones, decay of said tones, a note number of said tones and loudness of said tones.

5. The audio system as set forth in claim 1, in which said other data blocks of said at least one command file have respective blanked time data fields and respective user's data fields assigned to said at least one command data and pieces of user's data.

6. The audio system as set forth in claim 5, in which one of said pieces of user's data is used for specifying a music data file storing pieces of music data for a music tune to be reproduced by means of said signal-to-sound converter.

7. The audio system as set forth in claim 6, in which said pieces of music data express at least generation of tones, decay of said tones, a note number of said tones and loudness of said tones.

8. A signal producing apparatus communicable with a sound producing apparatus, comprising:

a storage unit storing at least one audio data file having data blocks assigned to pieces of audio data expressing discrete values on the waveform of an analog audio signal and other data blocks assigned to pieces of other sorts of data and at least one command file having data blocks corresponding to said data blocks of said at least one audio data file and other data blocks corresponding to said other data blocks of said at least one audio data file and assigned to at least one piece of command data expressing a command;

a signal producing unit connected to said storage unit and producing a digital audio signal and a device control signal from said pieces of audio data and said pieces of other sort of data in said at least one audio data file and from said at least one piece of command data in said at least one command file in such a manner that said digital audio signal is identical in format with said device control signal; and a communication unit connected to said signal producing unit and a communication channel connectable to said sound producing apparatus and delivering said digital audio signal and said device control signal to said communication channel.

9. The signal producing apparatus as set forth in claim 8, further comprising a signal-to-sound converter connected to said signal producing unit and converting said digital audio signal to said sound.

10. The signal producing apparatus as set forth in claim 8, in which said other data blocks of said at least one audio data file have respective time data fields assigned to pieces of time data expressing lapse of time and respective user's data fields assigned to pieces of user's data.

11. The signal producing apparatus as set forth in claim 10, in which one of said pieces of user's data is used for specifying a music data file storing pieces of music data for a music tune to be reproduced by means of said sound producing apparatus.

12. The signal producing apparatus as set forth in claim 8, in which said other data blocks of said at least one command file have respective blanked time data fields and respective user's data fields assigned to said at least one command data and pieces of user's data.

13. The signal producing apparatus as set forth in claim 12, in which one of said pieces of user's data is used for specifying a music data file storing pieces of music data for a music tune to be reproduced by means of said signal-to-sound converter.

14. A sound reproducing apparatus controllable by means of a signal producing apparatus connected thereto through a communication channel, comprising:

a communication unit connected to said communication channel and receiving a digital audio signal representative of pieces of audio data expressing discrete values on the waveform of an analog audio signal and pieces of other sorts of data stored in an audio data file and a device control signal representative of at least one piece of command data stored in a command file, said digital audio signal being identical in format with said device control signal, a signal-to-sound converter connected to said communication unit and responsive to said command so as to produce sound, and a command restorer connected to said communication unit and said signal-to-sound converter and restoring said device control signal to said at least one piece of command data expressing a command so as to control said signal-to-sound converter with said command.

15. The sound reproducing apparatus as set forth in claim 14, in which said file format has data blocks and other data blocks assigned to said pieces of audio data, the discrete values of which express at least part of said sound and said pieces of other sorts of data in said audio data file and to said pieces of audio data, the discrete values of which express silence and said at least one piece of command data in said command file.

16. The sound reproducing apparatus as set forth in claim 15, in which said other data blocks of said audio data file has respective time data fields expressing lapse of time and respective user's data fields blanked or storing a piece of user's data used for specifying a music data file, pieces of music data of which express at least other part of said sound.

17. The sound reproducing apparatus as set forth in claim 15, in which said other data blocks of said command file has respective blanked time data fields and respective user's data fields expressing said at least one piece of command data and pieces of user's data.

18. The sound reproducing apparatus as set forth in claim 17, in which one of said pieces of user's data is used for specifying a music data file, pieces of music data of which express at least other part of sound.

19. The sound reproducing apparatus as set forth in claim 14, in which said signal-to-sound converter includes an acoustic musical instrument for producing said at least other part of said sound, and an automatic playing system making said acoustic musical instrument produce said at least other part of said sound without any fingering of a human player.

20. The sound reproducing apparatus as set forth in claim 14, in which said signal-to-sound converter includes an electronic tone generating system for electronically producing said at least other part of said sound.

* * * * *